US008096490B2

(12) United States Patent
Yasukawa et al.

(10) Patent No.: US 8,096,490 B2
(45) Date of Patent: Jan. 17, 2012

(54) FUEL INJECTION VALVE AND FUEL INJECTION SYSTEM FOR INTERNAL COMBUSTION ENGINE WITH THE SAME

(75) Inventors: Yoshihito Yasukawa, Hitachinaka (JP); Eiji Ishii, Hitachinaka (JP); Noriyuki Maekawa, Kashiwa (JP); Motoyuki Abe, Hitachinaka (JP); Hiroshi Yamada, Isesaki (JP); Nobuaki Kobayashi, Maebashi (JP); Takahiro Saito, Isesaki (JP)

(73) Assignee: Hitachi, Ltd., Tokyo (JP)

( * ) Notice: Subject to any disclaimer, the term of this patent is extended or adjusted under 35 U.S.C. 154(b) by 1103 days.

(21) Appl. No.: 11/907,716

(22) Filed: Oct. 16, 2007

(65) Prior Publication Data

US 2008/0116301 A1 May 22, 2008

(30) Foreign Application Priority Data

Oct. 16, 2006 (JP) ..... 2006-280872

(51) Int. Cl.
*F02M 61/00* (2006.01)

(52) U.S. Cl. ..... 239/533.12; 239/552; 239/556; 239/558; 239/585.1; 239/585.4; 239/596; 239/900; 123/294; 123/305

(58) Field of Classification Search ..... 239/533.12, 239/552, 556, 558–561, 585.1, 585.4, 585.5, 239/900, 596; 123/294, 299, 305
See application file for complete search history.

(56) References Cited

U.S. PATENT DOCUMENTS

| | | | | |
|---|---|---|---|---|
| 5,881,957 | A | 3/1999 | Mizuno et al. | |
| 7,434,752 | B2 | 10/2008 | Matsunoto et al. | |
| 7,472,838 | B2 * | 1/2009 | Omura et al. | 239/533.12 |
| 7,481,383 | B2 * | 1/2009 | Joseph | 239/596 |
| 2004/0164187 | A1 | 8/2004 | Kihara et al. | |

FOREIGN PATENT DOCUMENTS

| | | | |
|---|---|---|---|
| JP | 9-317607 | A | 12/1997 |
| JP | 2002-115628 | A | 4/2002 |
| JP | 2003-148299 | A | 5/2003 |
| JP | 2004-3518 | A | 1/2004 |
| JP | 2004-197628 | A | 7/2004 |
| JP | 2004-225598 | A | 8/2004 |
| WO | WO 2005/035974 | A1 | 4/2005 |

OTHER PUBLICATIONS

Chinese Office Action issued Jan. 31, 2009 with English translation (Five (5) sheets).
Non Final Japanese Office Action dated Mar. 2, 2010 with partial English translation (Four (4) sheets).
Final Japanese Office Action dated Aug. 17, 2010 with partial English translation (Three (3) sheets).

* cited by examiner

*Primary Examiner* — Steven J Ganey
(74) *Attorney, Agent, or Firm* — Crowell & Moring LLP

(57) ABSTRACT

A fuel injection valve comprises a valve seat, a movable valve element which is seated on or separated from the valve seat, and a nozzle member having a plurality of nozzle holes. At least one of the valve element and valve seat has a curved surface at a contact position where they contact with each other when the valve element is seated on the valve seat. Two or more of the nozzle holes are provided outside an intersection line of a virtual extension surface along a tangential line to the curved surface at the contact position and a surface of the nozzle member.

7 Claims, 15 Drawing Sheets

VIEW TAKEN FROM C DIRECTION

| FUEL INJECTION VALE | SPRAY ANGLE | HC REDUCTION EFFECT | |
|---|---|---|---|
| | | BENCH TEST | IN-CAR TEST |
| CONVENTIONAL | BOTH θ2 AND θ3 ARE SMALL | STANDARD | STANDARD |
| PRESENT INVENTION | BOTH θ2 AND θ3 ARE LARGE | 11% | 11% |
| | BOTH θ2 AND θ3 ARE LARGE AND θ3 IS LARGER THAN θ2 | 21% | 21% |

FUEL INJECTION VALVE AND FUEL INJECTION SYSTEM FOR INTERNAL COMBUSTION ENGINE WITH THE SAME

CLAIM OF PRIORITY

This application claims priority from Japanese application serial No. 2006-280872, filed on Oct. 16, 2006, the content of which is hereby incorporated by reference into this application.

FIELD OF THE INVENTION

The present invention relates to a fuel injection valve for an internal combustion engine and a fuel injection system using the same.

BACKGROUND OF THE INVENTION

In recent years, exhaust gas regulations against automobiles have been tightened. For this reason, a fuel injection valve mounted on an internal combustion engine for an automobile is required to atomize fuel spray, inject the fuel spray toward on-target positions (for example, dual intake valves), thereby suppress adhesion fuel to an inner-wall surface of an intake pipe and others, and reduce the amount of noxious exhaust gas HC (hydrocarbon) from the internal combustion engine.

With regard to a conventional fuel injection valve, a method for accelerating the atomization of fluid with a relatively simple configuration has been disclosed. The atomization method is a method of forming a film of fluid injected from a nozzle hole and accelerating atomization while the fluid film expands and thereby splits (refer to JP-A No. 3518/2004).

Another document discloses a fuel injection valve of forming a nozzle plate having nozzle holes into a bowl shape to suppress deformation of the nozzle plate, thereby preventing injected fuel spray from becoming bad conditions, and directing the injected spray accurately (refer to JP-A No. 317607/1997).

By the aforementioned conventional technologies, it is possible to atomize fuel injected from a single fuel injection nozzle hole or a set of fuel injection nozzles. However, in the case of a fuel injection system where fuel sprays injected from a plurality of nozzle holes are integrated into sprays directed toward two directions for dual intake valves of an internal combustion engine, interference among a plurality of sprays a fuel occurs. Such interference becomes a cause of hindering atomization of fuel spray. The aforementioned conventional technologies have not described sufficiently to improve such a problem. Further, although the latter of the conventional technologies discloses the method for stabilizing fuel spray, it has not disclosed a method for accelerating atomization of fuel spray injected from a nozzle.

By the way, according to the combustion experiments for an internal combustion engine with two (dual) intake valves conducted by inventors for the present invention, obtained is the result that the effect of improving combustion can be obtained when the fuel injection is directed closer to the inside than the centers of two intake valves of the internal combustion engine and moreover a fuel fluid film is spread thinly and widely on the intake valves.

The first object of the present invention is to prevent interference between atomized fuel sprays, thereby prevent coarse particles of fuel sprays from forming and form two(dual)-direction spray with a high spreadability.

SUMMARY OF THE INVENTION

In order to realize the above object, the present invention is configured as follows basically.

A fuel injection valve comprises a valve seat, a movable valve element which is seated on or separated from the valve seat, and a nozzle member having a plurality of nozzle holes, at least one of the valve element and valve seat having a curved surface at a contact position where they contact with each other when the valve element is seated on the valve seat; wherein two or more of the nozzle holes are provided outside an intersection line of a virtual extension surface along a tangential line to the curved surface at the contact position and a surface of the nozzle member.

Further, in a fuel injection valve provided with a valve seat, a movable valve element, and a nozzle member having a plurality of nozzle holes, just as with the above-mentioned configuration, wherein two or more of the nozzle holes are provided outside an intersection line of a virtual extension surface along a flow direction of fuel flowing on the seat when the valve element is separated from the seat and a surface of the nozzle member.

Furthermore, in a fuel injection valve comprising a valve seat with a conical surface whose diameter is reduced toward the downstream side, a movable valve element which is seated on or separated from the valve seat, and a nozzle member having a plurality of nozzle holes, the following structure is proposed. Two or more of the nozzle holes are provided outside an intersection line of a virtual extension surface along the seat and the nozzle member.

According to such configurations, fuel flows along a slope (for example, conical surface) of the nozzle body through a gap between the valve element and the seat formed when the valve element is separated from the seat (when a state of the injection valve is changed from closing state to opening state). Then, fuel passing through the slope surface (for example conical surface) exfoliates at a wall surface of a fuel cavity formed just downstream from the slope surface including the seat (namely the cavity is formed between the slope surface of the nozzle body and nozzle member with the nozzle holes) because the wall surface of the fuel cavity forms discontiguous areas with the slope surface. The exfoliation of fuel induces local turbulence (local tumble flow) in the vicinity of the wall surface of the fuel cavity. After fuel injecting, the local turbulence enters into the injected fuel spray, thereby split of a fluid film of the fuel spray is accelerated to change into fine fluid drops.

In the above configuration, it is desirable that a ratio L/D of the shortest interval (L) between the nozzle holes to a diameter (D) of each nozzle hole is four or more.

According to the observation as to fuel spray of the inventors of the present invention, it has been clarified that each of fuel sprays injected from nozzle holes is spread up to about four times as large as the diameter of each nozzle hole until the injected spray is split. As a result of that, it is possible to prevent the interference between fuel sprays before a fluid film each of fuel sprays injected from the nozzle holes is split into fluid drops, thereby atomization for dual-direction spray is accelerated.

Furthermore, the following invention is proposed. That is, in a fuel injection valve provided with a valve seat, a movable valve element, and a nozzle member having a plurality of nozzle holes, just as with the above-mentioned configuration, wherein fuel sprays injected from the nozzle holes are integrated into two fuel sprays directed toward two directions. Furthermore, the sum (it's called so "dispersion angle") of a spray spread angle ($\theta 2$) of each spray viewed from a direction perpendicular to a plane including the two directions and a spray spread angle (θ3) thereof viewed from a direction parallel with a plane including the two directions is 30 degrees or more.

Still further, the following invention is proposed. That is, in a fuel injection valve provided with a valve seat, a movable valve element, and a nozzle member having a plurality of nozzle holes, just as with the above-mentioned configuration; wherein fuel sprays injected from the nozzle holes are integrated into two fuel sprays directed toward two directions; and a relationship between a spray spread angle (θ2) of a each spray viewed from a direction perpendicular to a plane including the two directions and a spray spread angle (θ3) thereof viewed from a direction parallel with a plane including the two directions is $\theta 2<\theta 3$.

Moreover, the following invention is proposed. That is, in a fuel injection valve provided with a valve seat, a movable valve element, and a nozzle member having a plurality of nozzle holes, just as with the above-mentioned configuration; wherein fuel sprays injected from the nozzle holes are integrated into two fuel sprays directed toward two directions; and a ratio H/ha between an average peak height (ha) obtained by dividing an integral of a flow rate of each of the two fuel sprays passing through a cross section at a specific position by a maximum spray spread width thereof at the same specific position and a peak height (H) in a flow rate distribution is two or less.

According to such configurations, it is possible to prevent the interference of atomized fuel sprays, thereby prevent particles of fuel spray from becoming coarse particles; and obtain atomized dual-direction spray of a high dispersion.

In addition, the following system is proposed. That is, in a fuel injection system for an internal combustion engine comprising dual intake valves for opening and closing two intake ports respectively, and a fuel injection valve which is driven on the basis of a control signal from an internal combustion engine controller and placed on an upstream side of the intake valves; wherein two fuel sprays injected in two directions from the injection valve are directed toward centers of the intake ports respectively; and cross-sectional areas of the two fuel sprays on outer surfaces of valve heads of the intake valves are formed into elliptical shape capable of being within areas of the outer surfaces of the valve heads respectively.

According to such a configuration, distributed two (dual) fuel splays are directed and reach to inside on the outer surfaces of the valve heads of the intake valves. A fluid film of the fuel on the valve heads are in elliptical shape and spread in thin fluid film state. The velocity of intake air flowing into the combustion engine through the intake valves is high at the inside of the intake valves. Therefore, by a synergistic effect of such high (rapid) air flow velocity and thin fluid film state of the fuel of the inside on the intake-valve heads, when fuel is fed to an internal combustion engine, atomization thereof is likely to be accelerated. As a result of that, good combustion in the engine is ensured, wall adhesion of the fuel is reduced, and HC discharged after combustion is reduced.

DETAILED DESCRIPTION OF THE PREFERRED EMBODIMENTS

Embodiments of the present invention are explained hereafter.

Embodiment 1

A first embodiment according to the present invention is explained in reference to FIGS. 1 to 11, 24, and 25.

Figure 1:
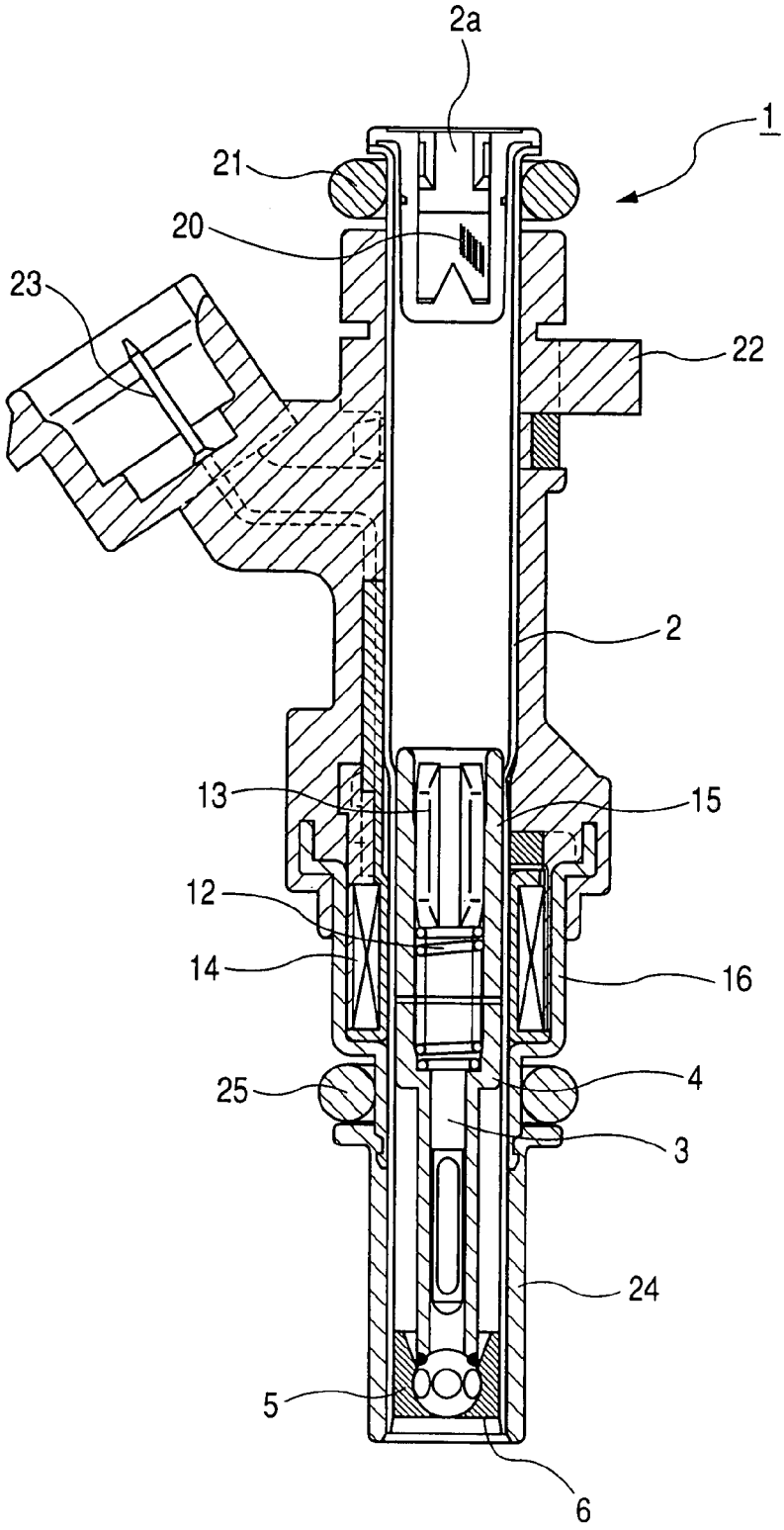
FIG. 1 is a sectional view showing the general configuration of a fuel injection valve according to a first embodiment of the present invention.

In FIG. 1, a fuel injection valve 1 is a device for feeding into an internal combustion engine used for an automobile engine for example. The fuel injection valve 1 is a multi-nozzle hole type injector that is a normally closed type injection valve. A valve casing 2 is formed into a slender and thin-walled cylindrical structure with a stepped bore by press working, cutting, or the like. The casing 2 is formed from a magnetic material which is made by containing a flexibility material such as titanium or the like into a ferritic stainless steel material. One end of the casing 2 is provided with a fuel supply inlet port 2*a* and another end thereof is provided with a nozzle body 5. A nozzle plate 6 as a nozzle member has a plurality of nozzle holes 7*a*, 7*b*, 7*c*, 7*d*, 7*e*, 8, 9*a*, 9*b*, 9*c*, 9*d*, 9*e*, and 10, and is fixed to the nozzle body 5. A magnetic coil 14 and a yoke 16 made of a magnetic material are disposed outside the casing 2 such that the yoke 16 encloses the magnetic coil 14. An interior of the casing 2 is provided with a stationary core 15, a hollow movable valve element 3 with an anchor (movable core) 4, and a nozzle body 5. The stationary core 15 is fixed inside the casing 2 to be positioned across the casing 2 from the magnetic coil 14. The anchor 4 and the valve element 3 are formed in one piece by a processing method such as MIM (Metal Injection Molding) which molds metal powder comprising a magnetic metal material. The anchor 4 is disposed in the manner of facing to one end of the core 15 so as to be movable in the axial direction of the casing 2 with a gap. The valve element 3 extends in the axial direction from the anchor 4. The nozzle body 5 is fixed at the one end of the casing 2 and has a valve seat 30 (refer to FIG. 2). The valve element 3 can be seated on or separated from the valve seat 30. The nozzle plate 6 is disposed at the one end of the nozzle body 5. The nozzle plate 6 is provided with a plurality of nozzle holes 7*a* to 7*e*, 8, 9*a* to 9*e*, and 10 (refer to FIG. 3). The nozzle plate 6 is fixed to the nozzle body 5 by welding and the nozzle body 5 is fixed to the casing 2 by welding.

A spring 12 as an elastic member is disposed inside the core 15. The spring 12 gives a force to press the valve element 3 against a conical surface of the valve seat 30 which is formed in nozzle body 5 such that the diameter of the conical surface is reduced toward the downstream direction. A spring adjuster 13 for adjusting the press force is disposed in the stationary core 15. A filter 20 is attached into the fuel supply inlet port 2*a* to remove foreign matters included in fuel. An o-ring 21 for fuel sealing is attached on the outer surface of the fuel supply inlet port 2*a*.

A resin cover 22 is provided to cover the casing 2 and the yoke 16 by means of resin molding for example and contains a connector 23 to supply electric power to the magnetic coil 14 therein.

A protector 24 for protecting the casing 2 is formed by a cylindrical member made of a resin material or the like for example, and attached at the one end of the fuel injection valve 1 so as to be positioned outside the casing 2. An o-ring 25 mounted on the outer surface of the casing 2. The o-ring 25 is disposed between the yoke 16 and the protector 24 for sealing a gap between an inner surface of an injection valve-mounting hole (not shown in the figure) in an intake pipe of an internal combustion engine and an outer surface of the injection valve 1 when the injection valve 1 is mounted into the injection valve-mounting holes.

In a fuel injection valve 1 configured as described above, when the magnetic coil 14 is in the state of not electrified, the tip (valve head) of the valve element 3 is pressed against the valve seat 30 of the nozzle body 5 by the pressing force of the spring 12. In such a state, a gap between the valve element and the valve seat, namely a fuel path, is not formed, thereby the injection valve is closed.

Hence the fuel flowing into the casing 2 from the fuel supply inlet port 2*a* is built-up inside the casing 2.

When electric current as a pulse signal for injection signal is applied to the magnetic coil 14, the yoke 16, the core 15, and the anchor 4 form a magnetic circuit. The valve element 3 moves toward the core 15 until it comes into contact with one end of the core 15 by the electromagnetic force of the magnetic coil 14. Thereby, a fuel path is formed between the valve element 3 and the seat 30 of the nozzle body 5. The fuel in the casing 2 flows in from the circumference of the valve element 3 and thereafter is sprayed through the nozzle holes 7*a* to 7*e*, 8, 9*a* to 9*e*, and 10. The amount of injected fuel is controlled by moving the valve element 3 in the axial direction and adjusting the timing of switching between the opened valve state and the closed valve state in response to the pulse signal intermittently applied to the magnetic coil 14.

Figure 2:
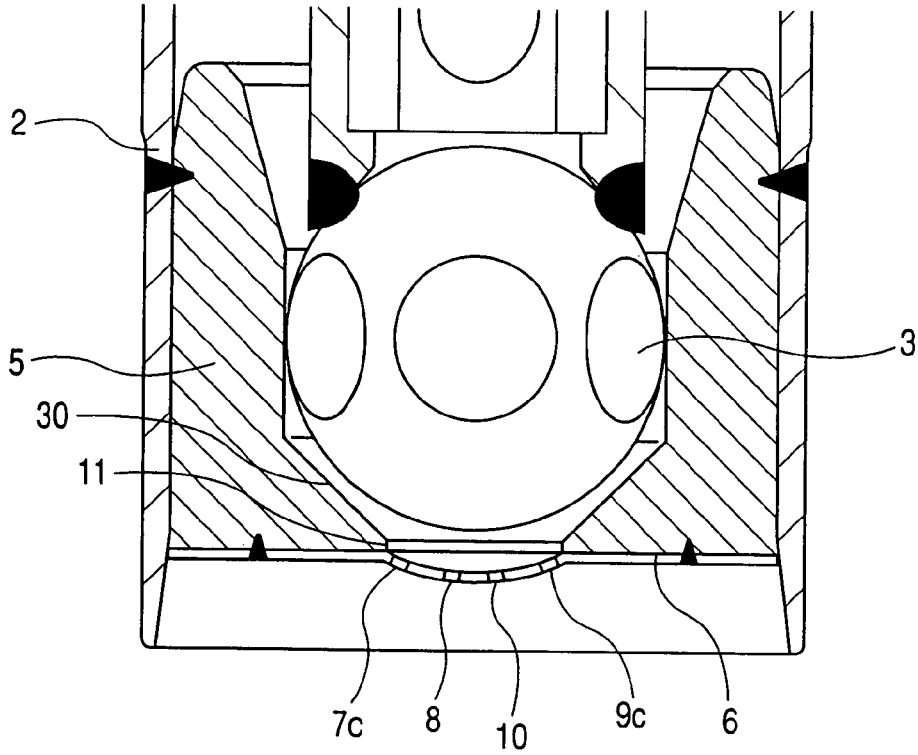
FIG. 2 is an enlarged sectional view showing the nozzle parts of a fuel injection valve according to the first embodiment of the present invention and corresponds to a sectional view taken on line A-A of FIG. 3.
Figure 3:
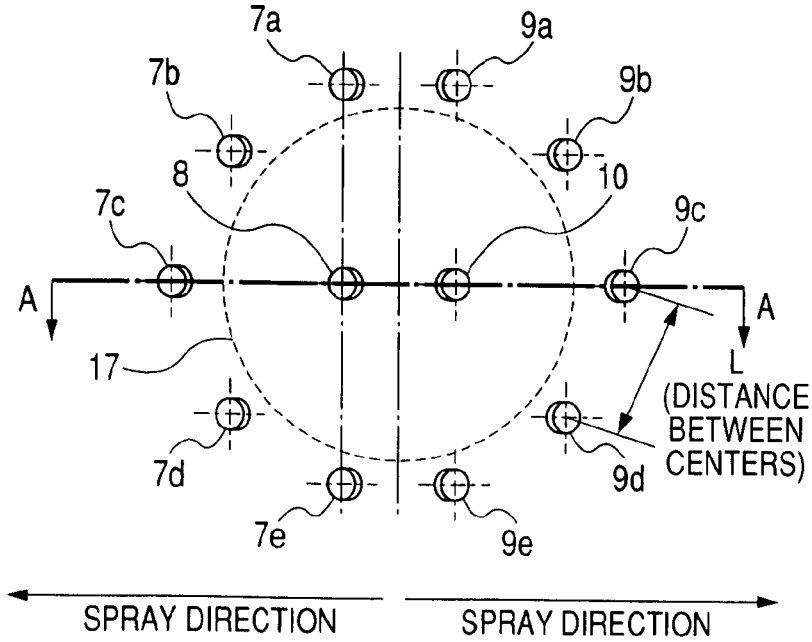
FIG. 3 is a view showing a schematic layout of nozzle holes according to the first embodiment of the present invention.
Figure 4:
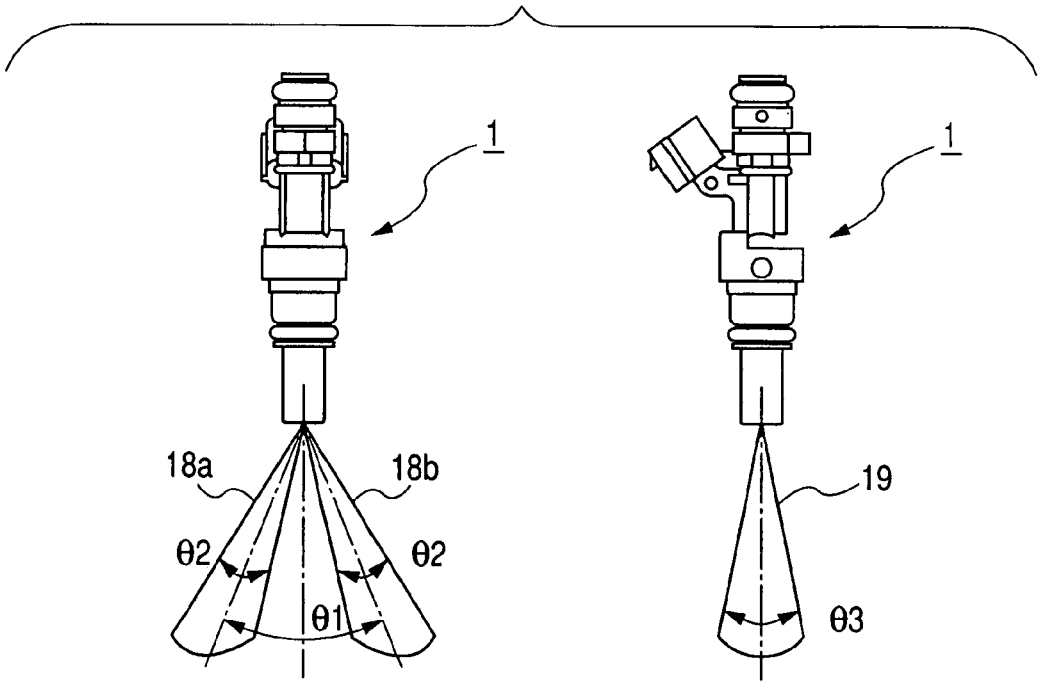
FIG. 4 comprises views showing the definition of spray angles of a fuel injection valve according to the first embodiment of the present invention.

Next, main parts according to the present invention are briefly explained in reference to FIGS. 2 to 4.

As shown in FIG. 2, a ball valve is used as the valve element 3. As the ball, for example, a steel ball for a ball bearing stipulated in the JIS Standard is used. The major reasons for employing such a steel ball are that: the ball has a high circularity, is mirror-finished, and thus is suitable for improving seat conformity; the cost is reduced due to mass production; and others. Further, when the ball is used for constructing the valve element, the diameter of the ball is about 3 to 4 mm. The purpose is to reduce the weight since the valve functions as a movable valve.

Further, in the nozzle body 5, the conical angle of the inclined surface (for example, tapered surface) including a seat position 30 for the valve element 3 is about 90° (80° to 100°). The inclined surface inclines at an angle of about 45° (40° to 50°) with reference to the center axis of the valve. The inclination angle is an angle most appropriate for polishing the vicinity of the seat position 30 and improving the circularity (a grinding machine can be used under the best conditions) and the seat conformity with the valve element 3 can be maintained at a very high level. Here, the hardness of the nozzle body 5 having the inclined surface including the seat position 30 is enhanced by quenching and magnetism is removed by demagnetizing treatment. By such a valve element configuration, injection amount control can be realized without fuel leakage. Furthermore, it is possible to provide a valve element configuration excellent in cost performance.

In the present specification, a conical surface (tapered surface: a surface inclined with reference to the center axis of the valve) including the seat position 30, whose diameter is reduced toward the downstream direction, is also called as a valve seat surface.

Further, the nozzle plate 6 takes the shape of a convex protruding downward so as to conform to a spherical shape since the head of the valve element 3 of the present embodiment is formed in spherical shape as ball. The convex protruding downward is formed by extrusion with a punch in a production process for forming a convex. In the present embodiment, the diameter of the punch is set at 6 to 9 mm in order to have the same shape as the valve element 3.

As shown in FIG. 3, the nozzle plate 6 has a plurality (for example 12 holes) of nozzle holes 7*a* to 7*e*, 8, 9*a* to 9*e*, and 10 as through holes. The outside nozzle holes 7*a* to 7*e* and the inside nozzle hole 8 constitute holes for one fuel spray group, and the outside nozzle holes 9*a* to 9*e* and the inside nozzle hole 10 constitute holes for another spray group. With regard to the hole diameter of each of the nozzle holes, as the hole diameter is small, it is necessary to increase the number of the holes in order to maintain the flow rate of the fuel injection valve 1 and the cost for piercing processing increases because of the degree of difficulty in processing. On the other hand, as the hole diameter is large, fuel is injected from large holes and thus the atomization is hardly accelerated. Consequently, it is necessary to design the diameter of the nozzle holes so as to be a prescribed value and the diameter is set at about 100 to 200 μm in the present embodiment. The reference character (L) in the figure indicates the distance between the center of the nozzle hole 9*c* and the center of the nozzle hole 9*d*.

As shown in FIG. 4, dual (two groups)-direction sprays 18*a*, 18*b* is formed from the fuel injection valve 1. The spray angle of the dual-direction spray is defined (as an example) in the following manner. The angle formed between the center lines of the sprays 18*a* and 18*b* is defined as θ1 and the spread angle (spray angle) of each of the fuel sprays 18*a* and 18*b* is defined as θ2 when the angles are viewed from the direction perpendicular to the plane including the two fuel spray directions; and the spread angle of the spray 19 viewed from the direction perpendicular to the above direction is defined as θ3.

Firstly, a method for accelerating atomization according to the first embodiment of the present invention is explained hereafter.

Figure 5:
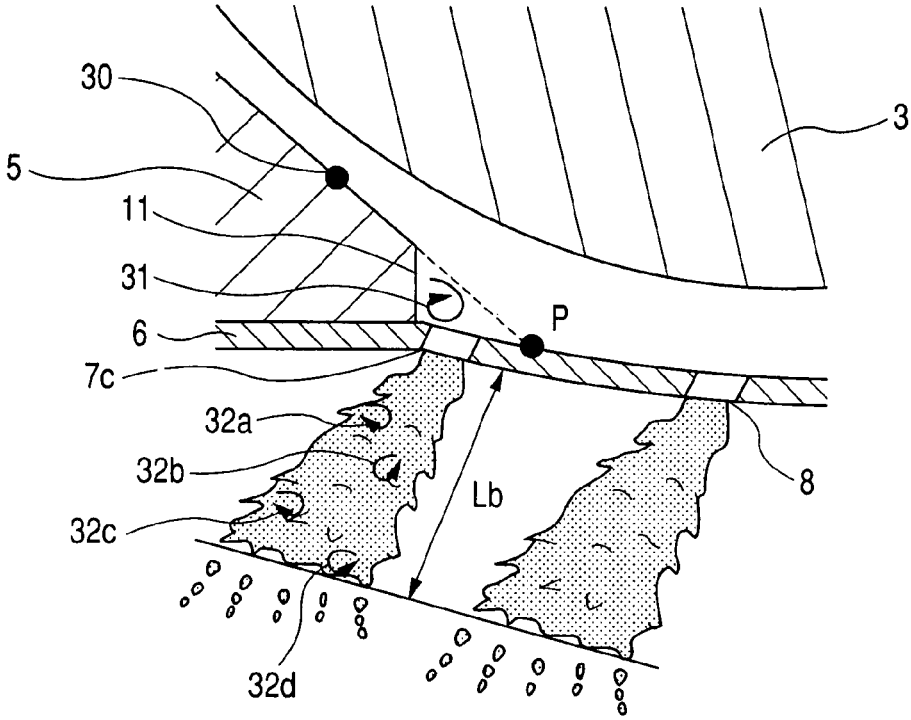
FIG. 5 is a view schematically showing a fuel flow and a spray shape in the vicinity of a nozzle hole according to the first embodiment of, the present invention.

As shown in FIG. 5, the present embodiment is characterized in that, when it is defined that the center axis of the fuel injection valve 1 is inside the intersection P of a virtual extension line (the broken line in FIG. 5) of the tangential line at the seat position 30 for a valve element 3 in a nozzle body 5 and a nozzle plate 6, a nozzle hole 7*c* is outside a virtual circular line 17 (refer to FIG. 3) passing through the intersection P. In other words, nozzle holes 7*a*-7*e* and 9*a*-9*e* are provided outside an intersection line (virtual circular line 17) of a virtual extension tapered surface along the tangential line (broken line in FIG. 5) to a curved surface of the valve element 3 at a contact position on the seat 30 and a surface of the nozzle plate 6. Further in other words, the nozzle holes 7*a*-7*e* and 9*a*-9*e* are provided outside an intersection line (virtual circular line 17) of a virtual extension surface along a flow direction of fuel flowing on the seat 30 when the valve element 5 is separated from the seat 30 and a surface of the nozzle plate 6. Furthermore in the other words, the nozzle holes 7*a*-7*e* and 9*a*-9*e* are provided outside an intersection line 17 of a virtual extension surface along the seat 30 and the nozzle plate 6.

When the valve element 3 is separated from the seat position 30 (namely during valve opening), fuel flows along a slope (inclined surface) including the seat position 30 through the gap between the valve seat 30 and the valve element 3. Further, after the fuel passes through the slope surface (conical surface), exfoliation of fuel flow is generated at a wall surface 11 of a fuel cavity (a short length of cylindrical bore) formed just down stream from the slope surface because the vertical wall surface 11 of the fuel cavity forms discontiguous areas with the slope surface. The exfoliation of fuel induces local turbulence (local tumble flow) 31 in the vicinity of the wall surface 11 of the fuel cavity. That is, local turbulence 31 is generated in the region surrounded by the extension of the tangential line at the seat position 30, the wall surface 11 forming the fuel cavity on the downstream side of the seat, and the nozzle plate 6. In FIG. 5, since the nozzle hole 7*c* is located immediately under the local turbulence 31, the turbulence 31 enters into the injected fuel spray, thereby split of a fluid film of the fuel spray is accelerated to change into fine fluid drops. Here, although only the nozzle hole 7*c* is described in the present embodiment, the same effect can be obtained with the nozzle holes 7*a*, 7*b*, 7*d*, 7*e*, 9*a*, 9*b*, 9*c*, 9*d*, and 9*e* disposed on the outside of the intersection line indicated by the virtual circular line 17 of the intersection P shown in FIG. 3. In FIG. 3, concerning the nozzle holes 8 and 10, since they are disposed in the vicinity of the center portion of the nozzle plate 6 (namely they are disposed inside the interference line 17), the effect of the turbulence 31 on atomization become reduced at the nozzle holes 8 and 10. However, since fuel with a high velocity of fuel flow passes through the nozzle holes 8 and 10, thereby the effect of the atomization for fuel spray injected the nozzle holes is ensured.

As a result of the observation of spray by the inventors of the present invention, it has been found that the spray of a fuel injection valve 1 according to the present embodiment spreads about four times of each of nozzle holes at a split distance (Lb) where the fluid film of the spray becomes fluid drops due to the effect of swirls entering into the spray. Consequently, when the shortest distance between the centers of adjacent nozzle holes for the same spray group in the present embodiment is defined as L (the distance between the centers of the nozzle holes 9*c* and 9*d* in FIG. 3 for example) and the diameter of the nozzle holes is defined as D, the ratio L/D is set at four or more.

Figures 23, 24:
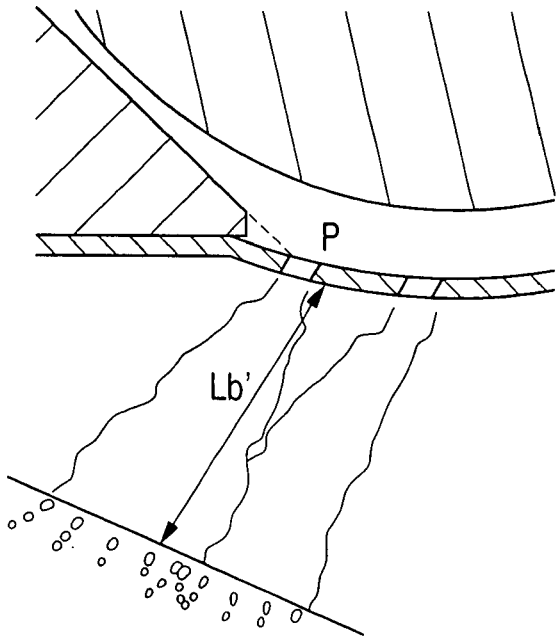
FIG. 23 is a table showing experimental results obtained by measuring the emissions of HC from an internal combustion engine with a fuel injection valve according to the tenth embodiment of the present invention.
FIG. 24 is a view schematically showing a spray pattern sprayed from the nozzle portion of a fuel injection valve according to a conventional embodiment.
Figure 25:
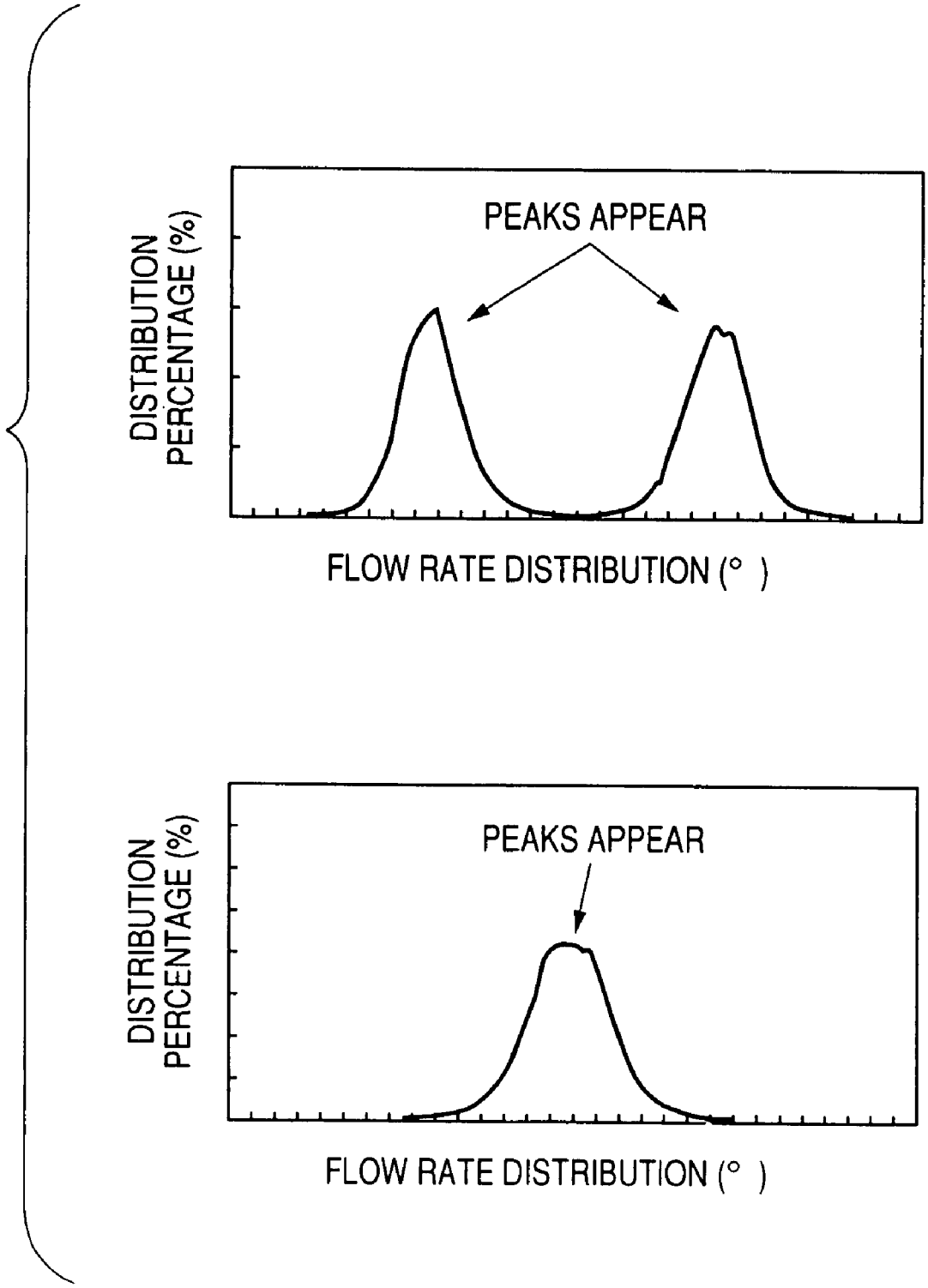
FIG. 25 comprises graphs showing the results obtained by actually measuring the distribution of fuel flow rates according to a conventional embodiment.

In a conventional fuel injection valve, as fuel spray injected from the injection valve is schematically shown in FIG. 24, the sprays injected from nozzle holes have sometimes interfered with each other before the sprays travel over the split distance Lb'. However, by disposing holes as shown in the present embodiment, since the adjacent sprays do not interfere with each other over the split distance Lb and the split for the spray can be accelerated as shown in FIG. 5, well-atomized dual-direction spray can be formed.

Here, a gap used for the fuel cavity formed between a nozzle plate 6 and a valve element 3, which affects the upstream flow of a nozzle hole, is described hereafter. If the gap is too narrow, it is estimated that the effect of the local turbulence caused by the exfoliation flow generated at the cavity-wall surface 11 is not obtained sufficiently, atomization can be not enough accelerated. Further, the narrow gap occurs pressure loss. On the other hand, if the gap is wide, the local turbulence caused by the exfoliation flow generated at the cavity-wall surface 11 attenuates undesirably and the effect of atomization decreases. For that reason, the gap of a prescribed space is desirable and is set at about 150 to 300 μm when the valve element 3 is separate from the nozzle body 5 in the present embodiment.

Figure 6:
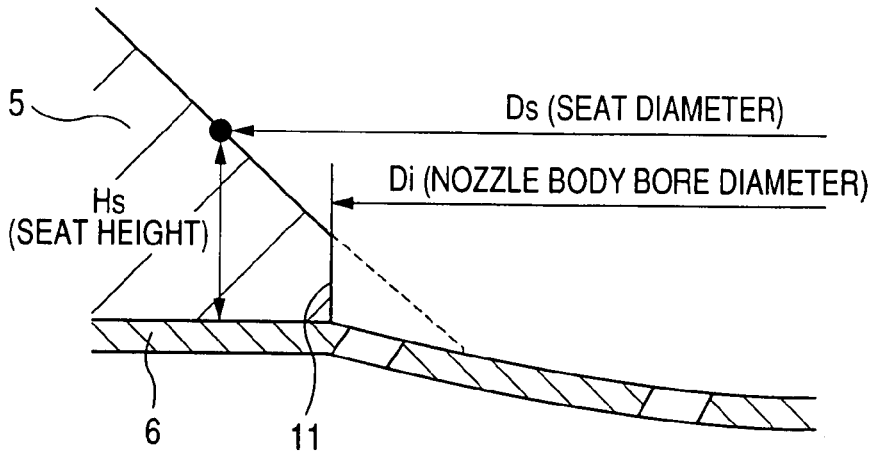
FIG. 6 is a view explaining the relationship among various dimensions at the nozzle portion of a fuel injection valve according to the first embodiment of the present invention.

With regard to the height Hs of the seat 30, the diameter Ds thereof, and a cylindrical bore diameter Di of the cavity, which influence processing for forming a cavity-wall surface 11, they are hereafter explained in reference to FIG. 6.

In FIG. 6, a desired diameter of a seat depends on the ball diameter of a ball valve 3 as valve element used in the present embodiment. The angle of the inclined (conical) surface including the seat position 30 of a nozzle body 5 is about 90° (80° to 100°) [inclines by about 45° (40° to 50°) with reference to the center axis of the valve] and hence, the diameter Ds of the seat position 30 for the ball valve 3 is 2 to 3 mm. Further, the seat height Hs is adjusted by machining the end face of the nozzle body 5 or another means. The nozzle body 5 receives impact from the ball valve 3 when the fuel injection valve 1 comes into contact with the valve seat position 30 and hence is required to withstand the impact force. Further, the seat height Hs influences also the height of the wall surface 11 forming the fuel cavity downstream the seat position. With regard to the swirl 31 generated on the nozzle hole 7*c* (or 7*a*-7*b*, 7*d*-7*e*, and 9*a*-9*e*), if the height Hs of the cavity-wall surface 11 is too low, the swirl 31 is not utilized, and if the height Hs of the cavity-wall surface 11 is too high, the force of the swirl 31 attenuates. Therefore, if the height Hs too low or high, the swirl 31 can not pass through the nozzle hole 7*c* effectively.

As a result of various experimental analyses and numerical calculations by the inventors, it has been found that a desirable seat height Hs is 350 to 550 μm and a desirable height of the cavity-wall surface 11 is about 250 to 450 μm. Further, the bore diameter Di is desirably about 1.5 to 2.5 mm in consideration of strength.

Here, although only the case where the diameters of the nozzle holes are identical is described in the present embodiment, the diameters of the nozzle holes may be different from each other for the adjustment of the flow rate of a fuel injection valve or the like in some cases. In this case, the ratio L/Dmax of the shortest distance L between the centers of the adjacent nozzle holes to the maximum diameter Dmax of the nozzle holes may be four or more.

Further, in the present embodiment, when a distance between centers of adjacent nozzle holes is discussed, it is only the case of that sprays interfere with each other in the formed spray group. Hence if the nozzle holes are used for different spray directions (for example, the nozzle holes 7*a* and 9*a*) the ratio L/D of the distance L between the centers of the adjacent nozzle holes to the diameter D of the nozzle holes may not be four or more.

Furthermore, with regard to the thickness of the nozzle plate 6, the following two points are taken into consideration. One is how many percentage of the force of the local turbulence 31 generated by the turbulence formed on the upstream side of a nozzle hole can be sent into spray. The other is to spray in a targeted direction. If the thickness is too thick, although the nozzle hole plays the role of a guide to fuel and allows to spray a targeted position, the swirl passing through the nozzle hole 7*c* (or 7*a*-7*b*, 7*d*-7*e*, and 9*a*-9*e*) is reduced before the swirl is ejected from the nozzle hole and the split force after spray is reduced. In contrast, if the thickness is too thin, fuel is prone to be injected in the direction inside the direction along the inclination of the nozzle hole and hence it becomes difficult to spray a targeted position. Consequently, it is desirable that the thickness of the fuel plate is in a prescribed range. In the present embodiment, the thickness is set at 70 to 120 μm.

Next, a method for forming fuel spray and the performance thereof according to the first embodiment of the present invention are explained in reference to FIGS. 7 to 11 and 25.

Figure 8:
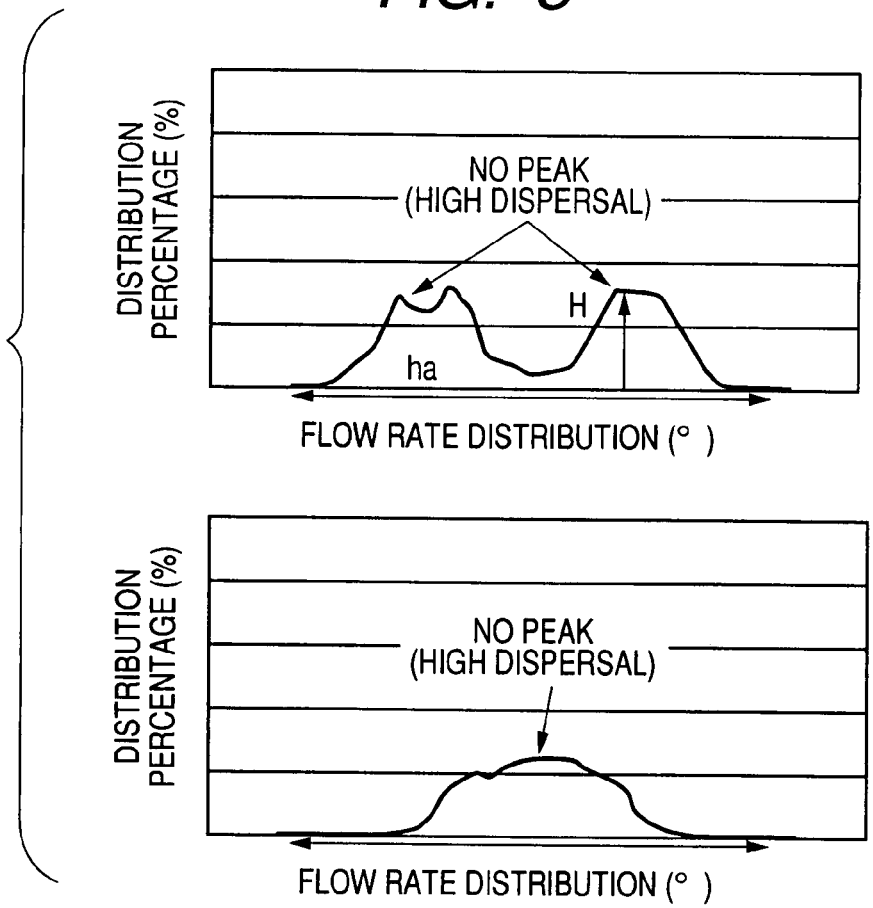
FIG. 8 comprises graphs showing the actual measurement result of the distribution of fuel flow rates according to the first embodiment of the present invention.
Figure 10:
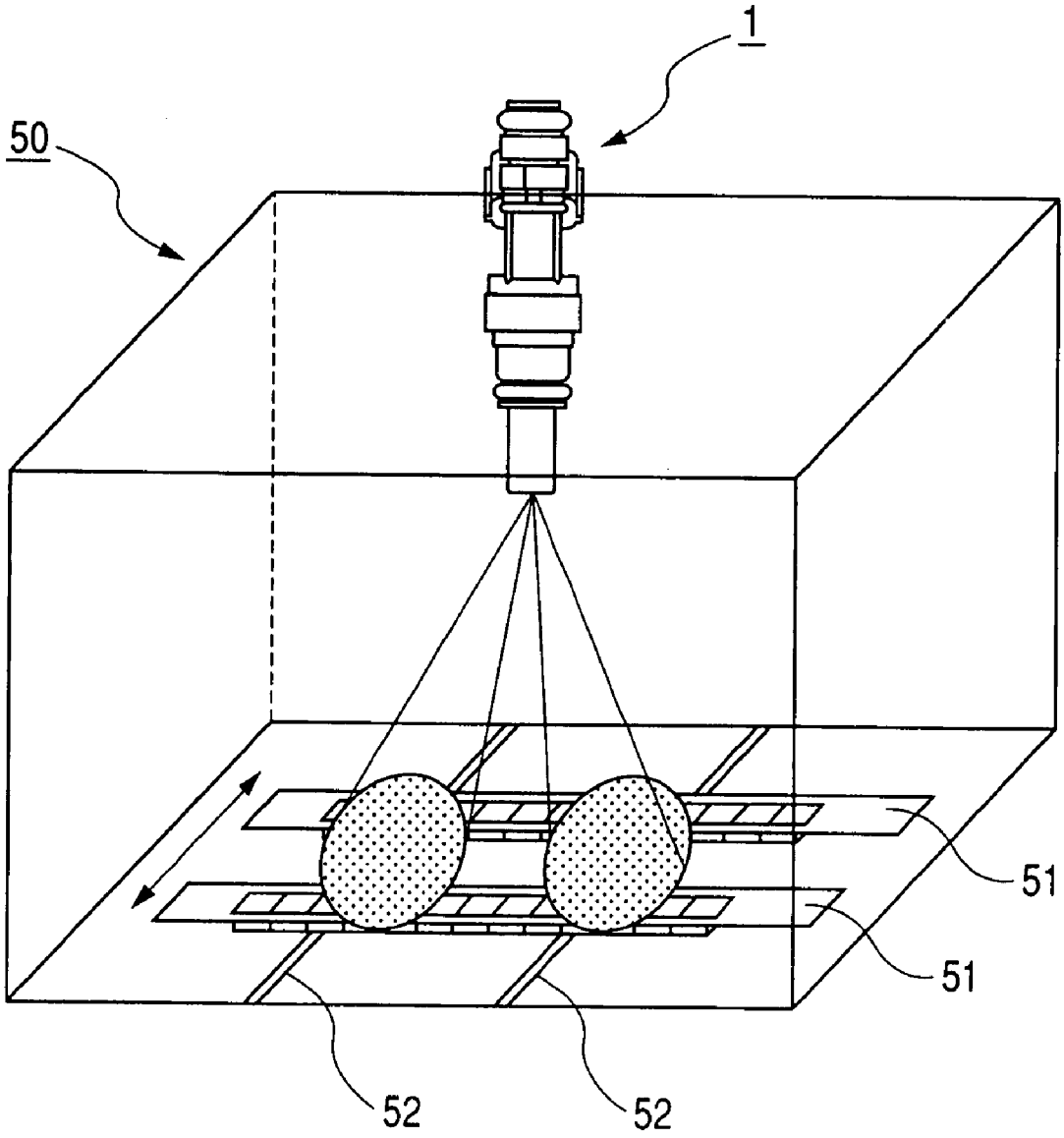
FIG. 10 is a schematic view showing a device for measuring a spray angle according to the first embodiment of the present invention.
Figure 11:
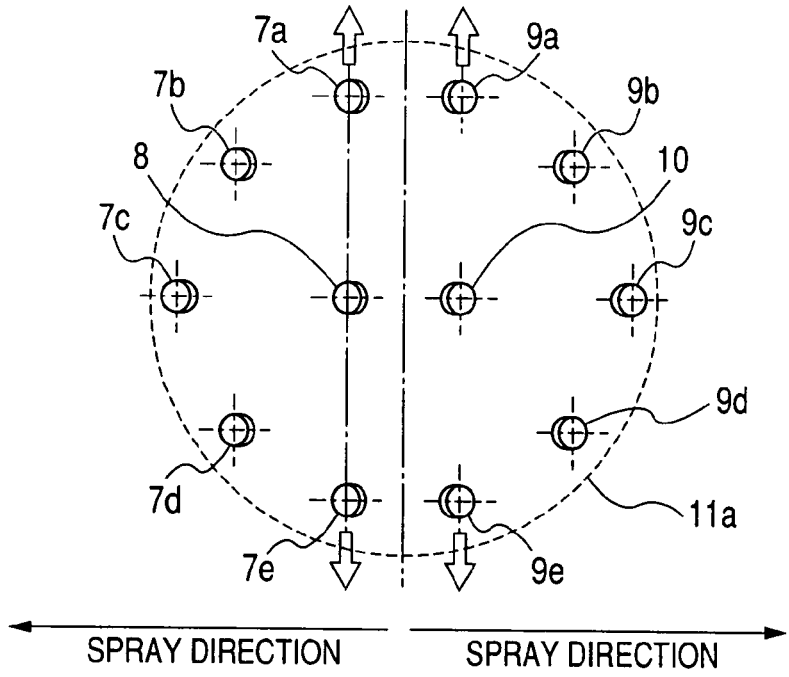
FIG. 11 is a view explaining the means for setting a spray angle according to the first embodiment of the present invention.

Firstly, a device for measuring a spray angle shown in FIG. 10 is explained. A fuel injection valve 1 is attached to the upper part of a spray angle measurement device 50. Fuel spray is collected at two fuel collecting sections 51 placed at the positions 100 mm below from the injection valve 1. The fuel collecting sections 51 have lattice-shaped holes (about 5 mm) to receive the fuel. Further, the fuel collecting sections 51 can move on transfer rails 52 with an automatic transfer mechanism not shown in the figure. The collected fuel is measured with a level sensor not shown in the figure, the fuel flow rate is subjected to data processing, and distribution percentages as shown in FIG. 8 are obtained. With regard to the test conditions on this occasion, the fuel used for the measurement is n-Heptane and the fuel injection pressure is 300 kPa.

A spray angle (another example) is obtained from the distribution percentage obtained with the device. θ1 is defined as the angle between the center lines of the angles formed by the dual-direction sprays. θ2 is defined as the angle formed by the region wherein the flow rate is 5% to 95% when a cumulative flow rate is determined for one of dual-direction sprays. θ3 is defined by applying the same method as θ2 to dual-direction sprays viewed from the one side direction. In the present invention, the sum of θ2 and θ3 is defined as a dispersion angle.

Further, the after-mentioned dispersion index is defined as the ratio H/ha between an average peak height ha obtained by dividing the integral of the rate of a flow passing through a specific position (here, 100 mm below the nozzle hole) on the downstream side of the spray by the maximum spread width of the spray at the same specific position (the outermost position in a front view) and the peak height H in the flow rate distribution.

Figure 7:
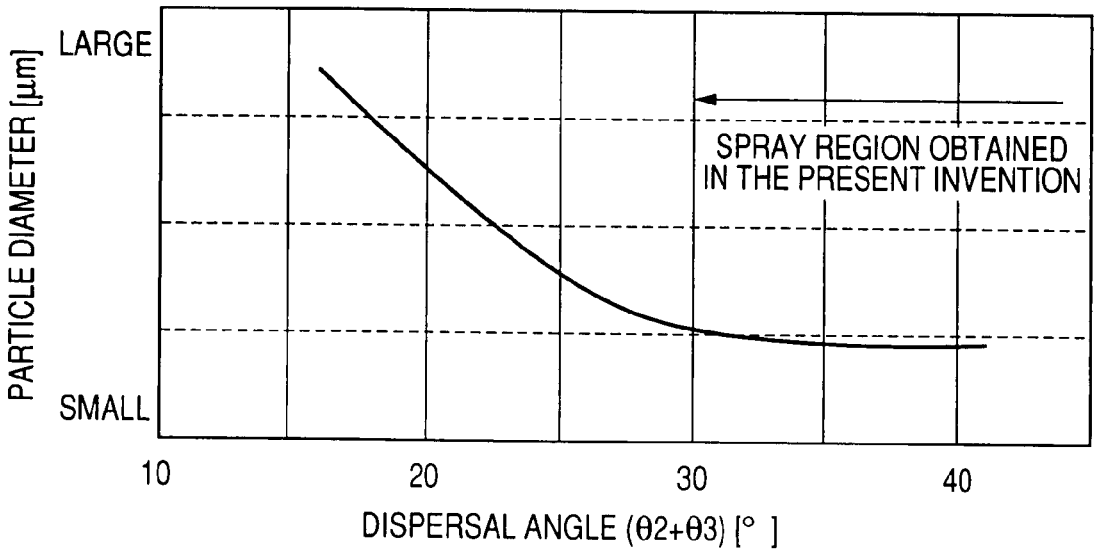
FIG. 7 is a graph showing the actual measurement result of the relationship between a dispersion angle of spray and a particle diameter according to the first embodiment of the present invention.

The relationship between a dispersion angle and a particle diameter is shown in FIG. 7. When the dispersion angle is 30° C. or more, the particle diameter is nearly constant. When the dispersion angle is increased to 30° or more, the interference of spray is prevented and atomization accelerates. The particle diameter is nearly equalized to 50 to 60 μm. As a result, it is possible to obtain well-atomized dual-direction sprays of a high dispersion.

Such dual-direction sprays of a high dispersion is defined by a dispersion index (H/ha) devised by the inventors. The obtained findings are explained in reference to FIG. 8. The distribution chart shown on the upper side of FIG. 8 shows the flow rate distribution of dual-direction sprays and the distribution chart shown on the lower side of FIG. 8 shows the fuel flow rate distribution viewed from the direction perpendicular to the plane on which the dual-direction sprays are formed. It has been found that the dispersion index (H/ha) of the fuel distribution shown in the figure is two or less.

Figure 9:
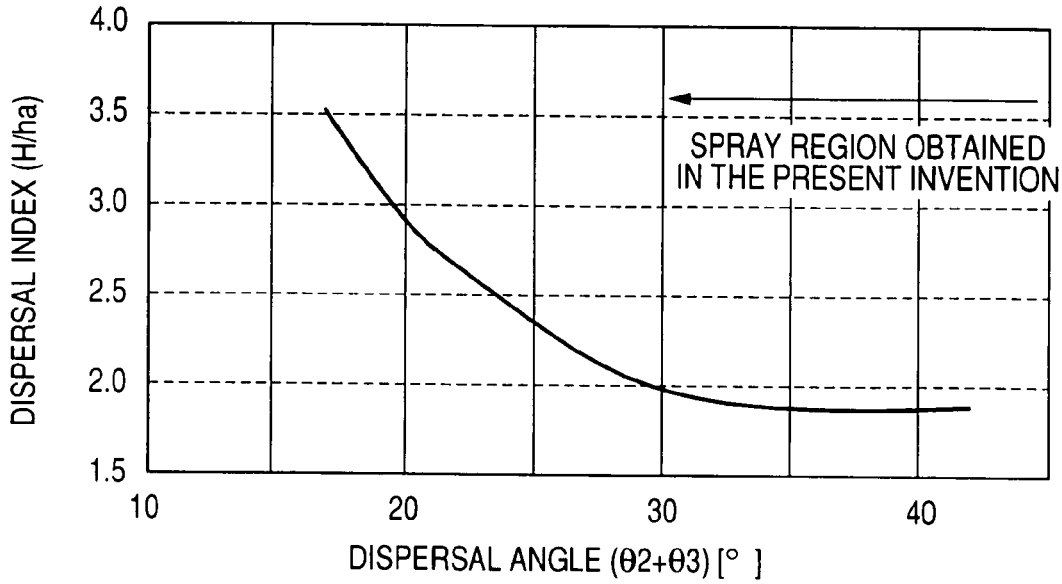
FIG. 9 is a graph showing the actual measurement result of the relationship between a dispersion angle and a dispersion index of spray according to the first embodiment of the present invention.

The relationship between a dispersion angle and a dispersion index (H/ha) is shown in FIG. 9. It has been found that, in the case of a fuel injection valve wherein the dispersion angle (θ2+θ3) of spray angles measured by the above method is 30° or more, the dispersion index (H/ha) is always two or less. Here, in the case of a conventional fuel injection valve shown in FIG. 25, the calculated dispersion index (H/ha) is 3.3. In this way, a small dispersion index means that the spray is highly dispersive.

From the above results too, it is obvious that, with a fuel injection valve according to the present embodiment, the interference of sprays is prevented and highly-dispersive dual-direction spray is formed.

Further, a spray angle θ3 defined by the inventors can be changed by moving the nozzle holes 7*a*, 7*e*, 9*a*, and 9*e*. For example, it is possible to widen the spray angle by allocating the nozzle holes 7*a*, 7*e*, 9*a*, and 9*e* further outside as shown with the arrows in FIG. 11. By so doing, the nozzle holes come close to the cavity-wall surface 11 (shown with the virtual line 11*a*) on the downstream side of a seat and hence atomization can be accelerated by using the local turbulence generated at the upper parts of the nozzle holes 7*a*, 7*e*, 9*a*, and 9*e*. That is, since the interference of sprays is prevented while the atomization capability is maintained, it is possible to suppress the generation of coarse particles and obtain highly-dispersive dual-direction spray. The above explanations are based on the case of allocating the nozzle holes 7*a*, 7*e*, 9*a*, and 9*e* further outside but, by allocating them inside too, it is possible to obtain similar functions and effects as long as they are allocated in the range allowing atomization using the local turbulence. Here, although the spray angle θ3 can be adjusted also by inclining a nozzle hole, the machining becomes difficult as the inclination of the nozzle hole increases, and hence the forming of a nozzle hole is properly selected in consideration of machinability too.

Further, although the number of the nozzle holes is twelve in the present embodiment, the number of holes depends on the flow rate of the fuel injection valve and the functions and effects of the present invention are not limited to the case of twelve holes.

Embodiment 2

Figure 12:
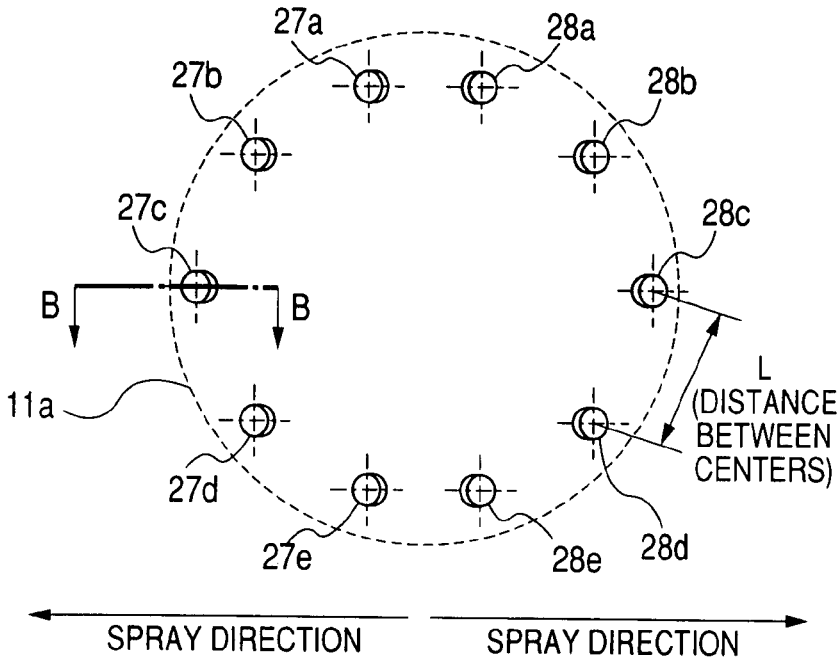
FIG. 12 is a view showing a schematic layout of nozzle holes according to a second embodiment of the present invention.
Figure 13:
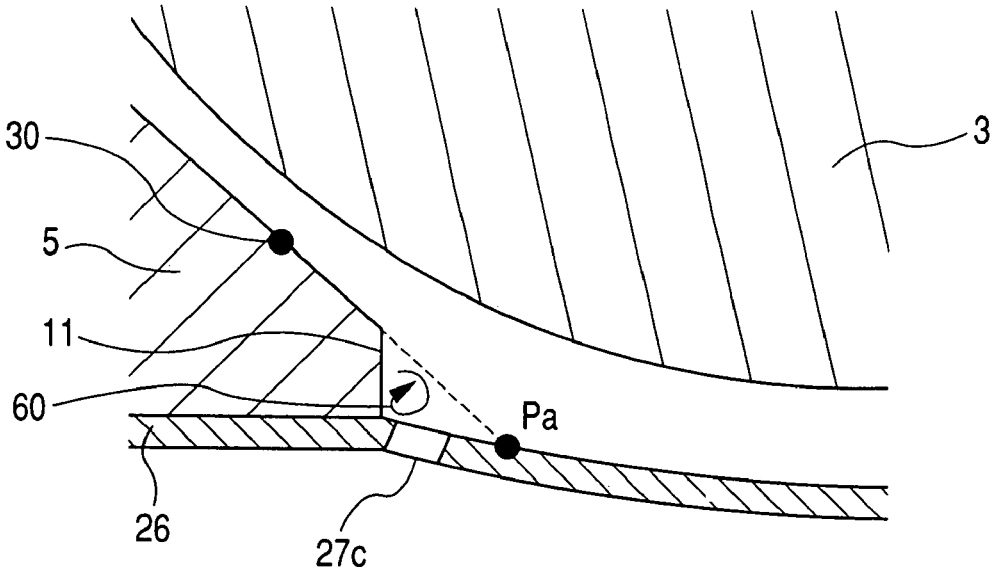
FIG. 13 is a sectional view taken on line B-B of FIG. 12 according to the second embodiment of the present invention.

A second embodiment of a fuel injection valve to which the present invention is applied is explained in reference to FIGS. 12 and 13. FIG. 12 is a view showing a layout of nozzle holes and FIG. 13 is an enlarged view showing the vicinity of a nozzle hole and corresponds to a cross sectional view taken on line B-B. The components represented by the same reference numerals as FIGS. 3 and 5 have the functions identical or equal to the first embodiment and thus the explanations are omitted.

The point different from the first embodiment is that all the nozzle holes 27*a*, 27*b*, 27*c*, 27*d*, 27*e*, 28*a*, 28*b*, 28*c*, 28*d*, and 28*e* are located outside the intersection line 17 (refer to FIG. 3: virtual circular line including interception point Pa of the extension of the tangential line at the seat position 30 of a nozzle body 5 for valve element 3 and a nozzle plate 26).

By so doing, local turbulence (local tumble flow) 60 can be formed on the upstream side of the nozzle hole of each of the nozzle holes. As a result, the local turbulence enters into each fuel spray to split the fluid film of the spray and thereby atomization of the spray is accelerated. This is appropriate for the case where a fuel injection valve that can accelerate atomization at a low flow rate is realized.

Embodiment 3

Figure 14:
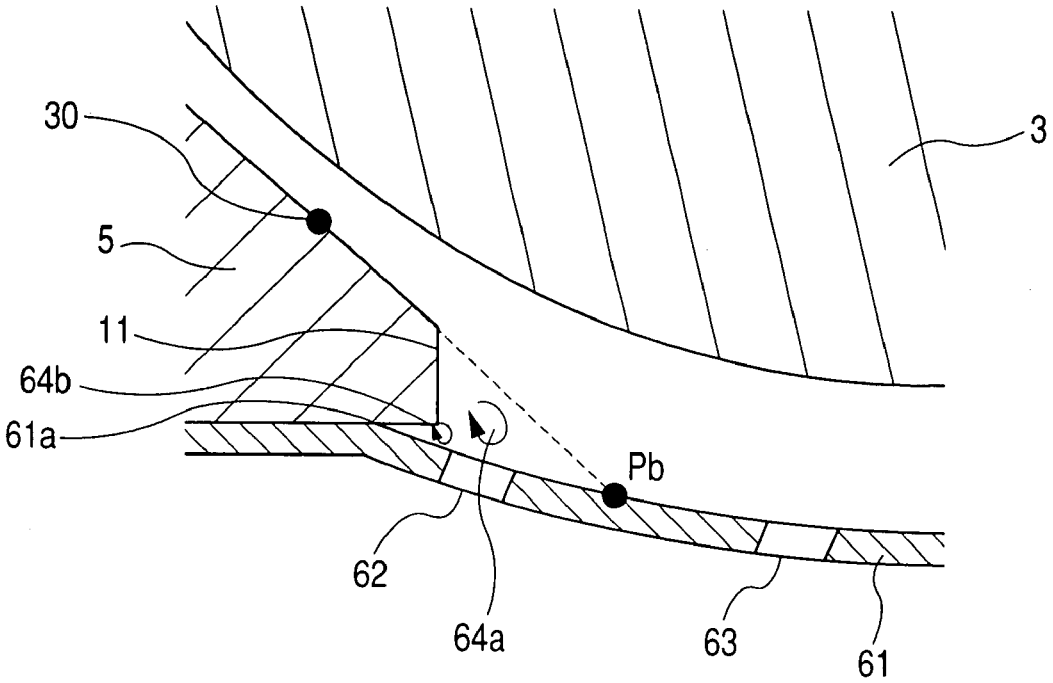
FIG. 14 is an enlarged sectional view showing the nozzle portion of a fuel injection valve according to a third embodiment of the present invention.

A third embodiment of a fuel injection valve to which the present invention is applied is explained in reference to FIG. 14. FIG. 14 is an enlarged sectional view showing the vicinity of a nozzle hole of a fuel injection valve according to the present embodiment. The components represented by the same reference numerals as FIG. 5 have the functions identical or equal to the first embodiment and thus the explanations are omitted.

The point different from the first embodiment is that the starting point 61*a* (namely a circumference) of a spherical convex portion protruding downward on the nozzle plate 61 is located on the outer side of the wall surface 11 forming the fuel cavity on the downstream side of the seat of a nozzle body 5. Namely, by increasing the extrusion (spherical convex area) of the nozzle plate 61 with a punch, the starting point 61*a* of the spherical convex on the nozzle plate can be located outside the cavity-wall surface 11 on the downstream side of the seat. In the present embodiment in particular, since the local turbulence (local tumble flow) 64*b* is formed also outside the cavity-wall surface 11, it is possible to place the nozzle hole 62 located further outside the intersection line 17 (refer to FIG. 3: namely virtual circular line including point Pb of the tangential line at the seat position 30 and the nozzle plate 61). By so doing, the problem of interference of sprays is solved further. As a result, it is possible to widen the intervals between the nozzle holes, increase the number of holes, and preferably realize a fuel injection valve that can be used at a high flow rate and can accelerate atomization.

Fourth to ninth embodiments on a nozzle body and a valve element are explained hereunder.

Embodiment 4

Figure 15:
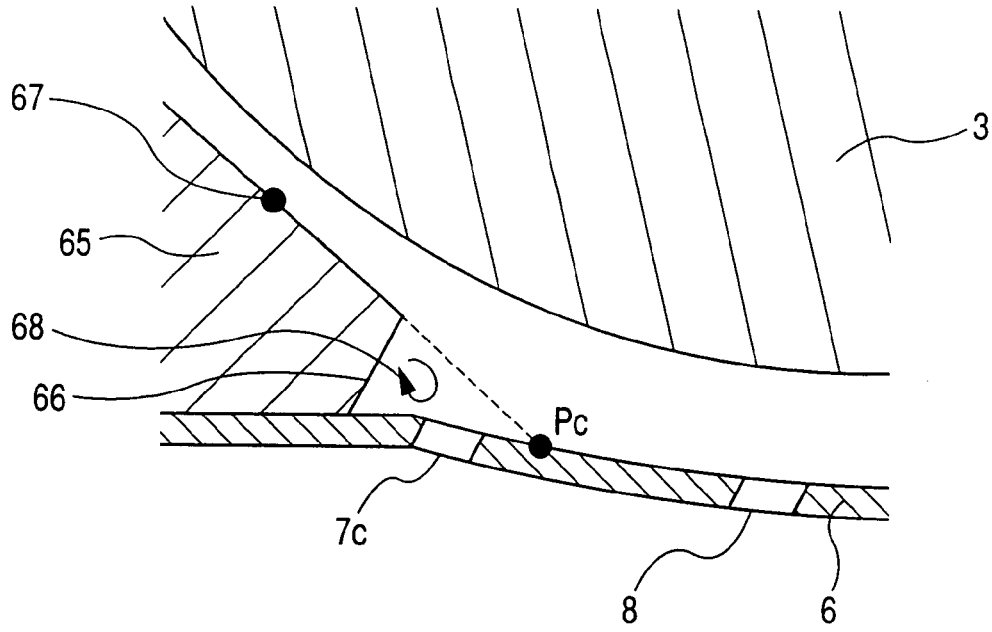
FIG. 15 is an enlarged sectional view showing the nozzle portion of a fuel injection valve according to a fourth embodiment of the present invention.

The fourth embodiment of a fuel injection valve to which the present invention is applied is explained in reference to FIG. 15. FIG. 15 is an enlarged sectional view showing the vicinity of a nozzle hole of a fuel injection valve according to the present embodiment. The components represented by the same reference numerals as FIG. 5 have the functions identical or equal to the first embodiment and thus the explanations are omitted.

The point different from the first embodiment is that the diameter of a wall surface 66 (corresponding to the wall surface 11 of previous embodiment) forming the fuel cavity on the downstream side of the seat of a nozzle body 65 (corresponding to the nozzle body 5 of previous embodiments) spreads toward a nozzle plate 6. In the nozzle body 65, the cavity-wall surface 66 spread toward the nozzle plate 6 is formed by machining or the like. In the present embodiment in particular, since the diameter of the cavity-wall surface 66 spreads, the region of forming the local turbulence (local tumble flow) can spread. Otherwise, the local turbulence (a tumble flow) 68 is also formed further outside the nozzle hole 7*c*. In order to effectively use the local turbulence (the small tumble flow) 68, it is preferable to place the nozzle hole 7*c* existing further outside the intersection line 17 (the virtual line including the intersection Pc of extension of the tangential line at a seat position 67 and a nozzle plate 6). By so doing, the problem of interference of sprays can be solved further. As a result, it is possible to widen the intervals between the nozzle holes, increase the number of holes, and preferably realize a fuel injection valve that can be used at a high flow rate and can accelerate atomization.

Embodiment 5

Figure 16:
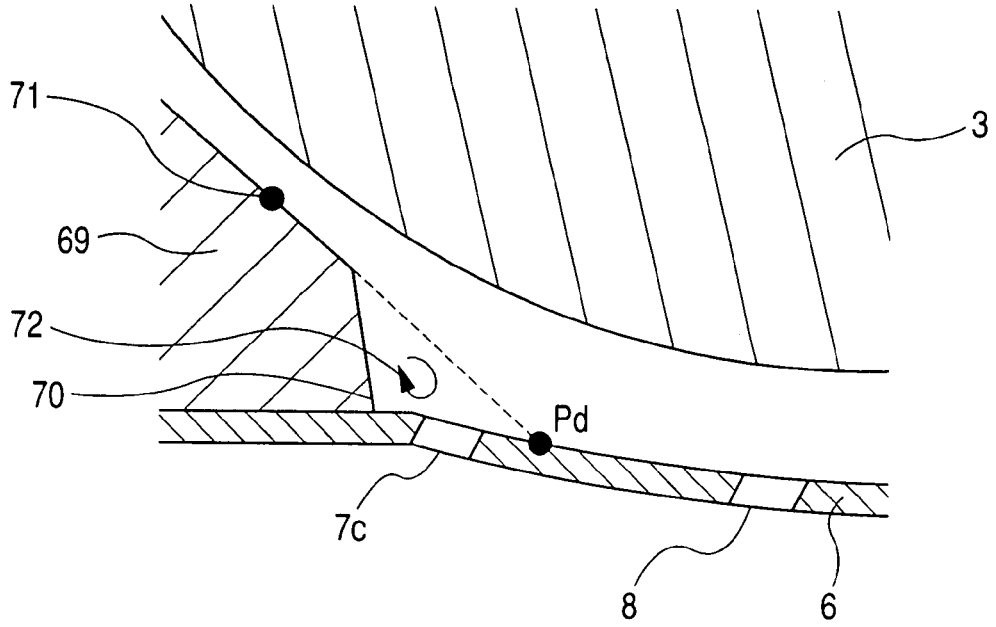
FIG. 16 is an enlarged sectional view showing the nozzle portion of a fuel injection valve according to a fifth embodiment of the present invention.

The fifth embodiment of a fuel injection valve to which the present invention is applied is explained in reference to FIG. 16. FIG. 16 is an enlarged sectional view showing the vicinity of a nozzle hole of a fuel injection valve according to the present embodiment. The components represented by the same reference numerals as FIG. 5 have the functions identical or equal to the first embodiment and thus the explanations are omitted.

The point different from the first embodiment is that the diameter of a wall surface 70 (corresponding to the wall surfaces 11 and 66 of previous embodiments) forming the fuel cavity on the downstream side of the seat of a nozzle body 69 (corresponding to the nozzle bodies 5 and 65 of previous embodiments) reduces toward a nozzle plate 6. In the nozzle body 69, the cavity wall surface 70 is also formed by machining or the like. By employing such a configuration too, the nozzle hole 7*c* is placed outside the intersection line (namely virtual circular line including intersection Pd of the extension of the tangential line at the seat position 71 for a valve element 3 and a nozzle plate 6 as shown in FIG. 16. Hence the local turbulence (local tumble flow) 72 is formed on the upstream side of the nozzle hole 7*c* and atomization of the fuel spray is accelerated.

Example 6

The sixth embodiment of a fuel injection valve to which the present invention is applied is explained in reference to FIG.

Figure 17:
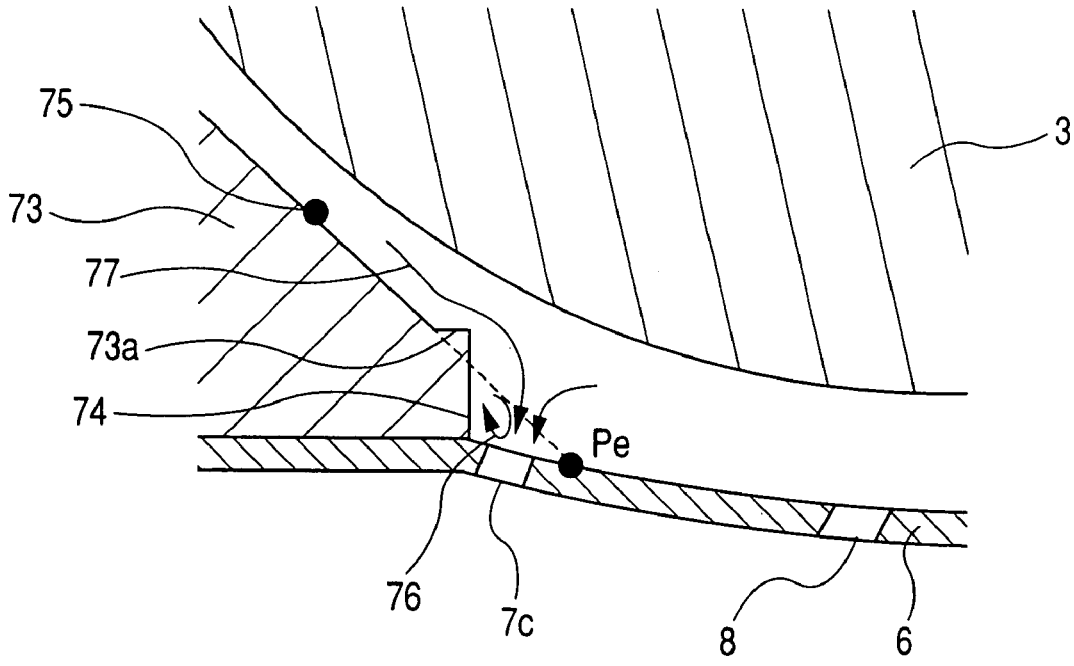
FIG. 17 is an enlarged sectional view showing the portion of a fuel injection valve according to a sixth embodiment of the present invention.

17. FIG. 17 is an enlarged sectional view showing the vicinity of a nozzle hole of a fuel injection valve according to the present embodiment. The components represented by the same reference numerals as FIG. 5 have the functions identical or equal to the first embodiment and thus the explanations are omitted.

The point different from the first embodiment is that a nozzle body 73 (corresponding to nozzle bodies 5, 65, and 69 of the previous embodiments) has a step-like surface 73*a* nearly parallel with the bottom surface of the nozzle body 73 between the inclined surface (tapered surface) of the nozzle body 73 including a seat position 75 (corresponding to the seat positions 30, 67 and 71) for the a valve element 3 and a wall surface 74 (corresponding to the wall surface 11, 66, and 70 of the previous embodiments) forming the fuel cavity on the downstream side of the seat.

According to such a configuration, the following action is executed. When the valve is opened, the fuel flows along the inclined surface of the nozzle body 73 including the seat position 75 through a gap between the seat position 75 and the valve element 3, after that, the fuel collides with the step-like surface 73*a*. Thereafter, an exfoliation flow is generated in the collided flow at the cavity wall surface 74 on the downstream side of the seat. Then the fuel flows into a nozzle hole 7*c* (and 7*a*-7*b*, 7*d*-7*e*, and 9*a*-9*e*) provided outside the intersection line (virtual circular line intersection Pe of the extension of the tangential line at the seat position 75 and a nozzle plate 6 as shown with the arrow 77 in the figure.

Such a configuration causes the fuel having collided with the seat surface 73*a* to generate strong the local turbulence (local tumble flow) 76 on the upstream side of a nozzle hole. Consequently, the configuration is appropriately applied to the case of realizing a fuel injection valve that can accelerate atomization.

Example 7

Figure 18:
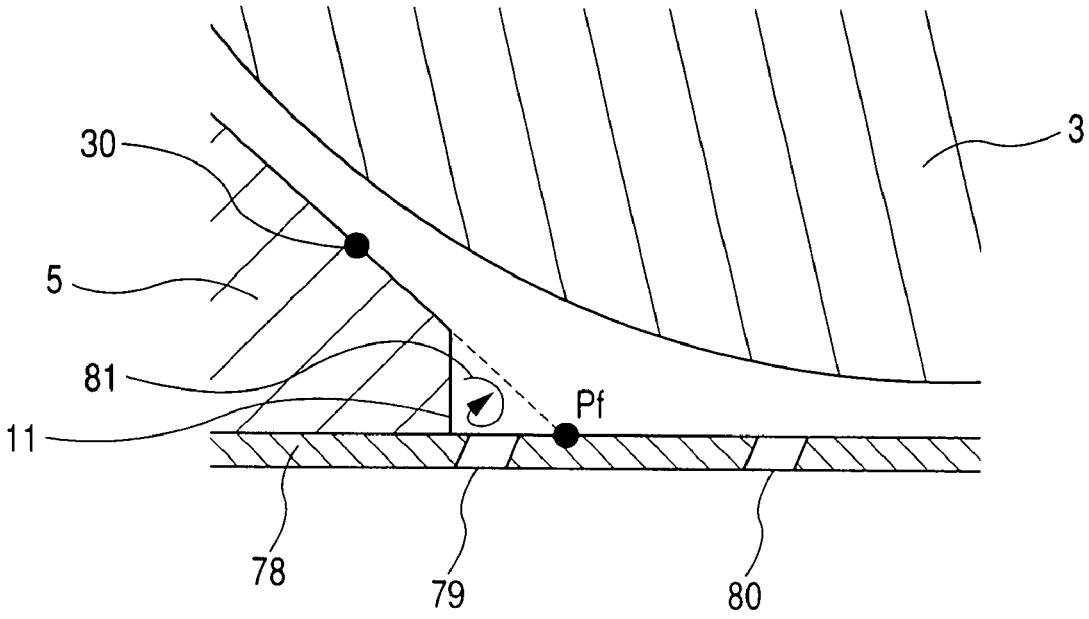
FIG. 18 is an enlarged sectional view showing the portion of a fuel injection valve according to a seventh embodiment of the present invention.

The seventh embodiment of a fuel injection valve to which the present invention is applied is explained in reference to FIG. 18. FIG. 18 is an enlarged sectional view showing the tip of a fuel injection valve according to the present embodiment. The components represented by the same reference numerals as FIG. 5 have the functions identical or equal to the first embodiment and thus the explanations are omitted.

The point different from the first embodiment is that a nozzle plate 78 is flat.

In the present embodiment, since a nozzle plate 78 (corresponding to the nozzle plate 6 of the previous embodiments) has a flat shape, the production processes are reduced and the cost is also reduced. Even when such a configuration is employed, like the first embodiment, a nozzle hole 79 (corresponding to the nozzle hole 7*c* of the previous embodiments) is placed outside the intersection line (virtual circular line including intersection Pf of the extension of the tangential line at the seat position 30 for a valve element 3 and a nozzle plate 78 (corresponding to the nozzle plate 6 of the previous embodiments). By so doing, exfoliation occurs in the fuel flowing along the inclined surface including the seat point 30 at the cavity-wall surface 11. The local turbulence (a local tumble flow) 81 is formed on the upstream side of the nozzle hole of the nozzle hole 79. Consequently, the local turbulence enters into each fuel sprays and thereby atomization is accelerated.

Example 8

Figure 19A:
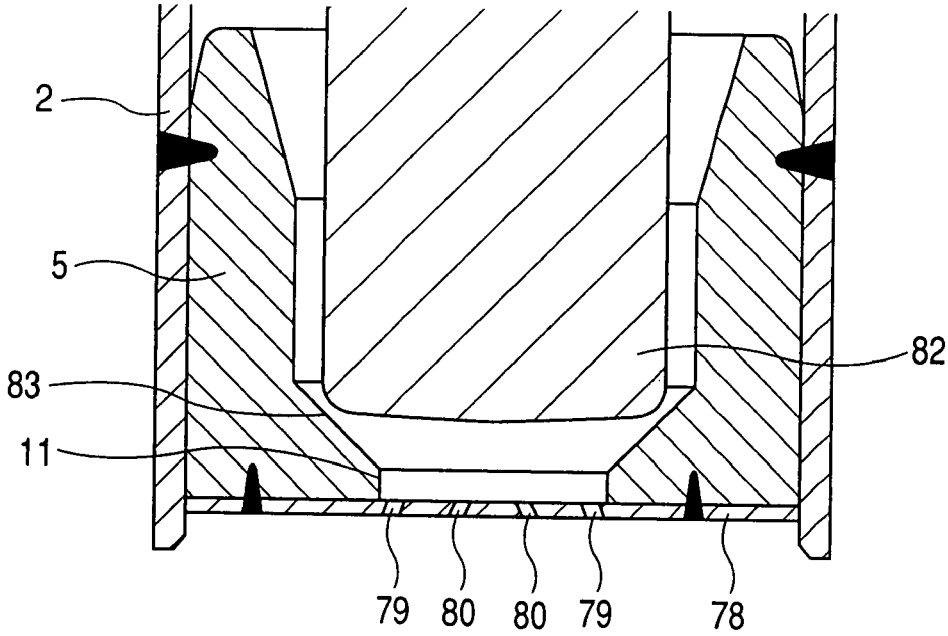
FIG. 19(*a*) and FIG. 19 (*b*) comprise enlarged sectional views showing the nozzle portion of a fuel injection valve according to an eighth embodiment of the present invention.

The eighth embodiment of a fuel injection valve to which the present invention is applied is explained in reference to FIGS. 19(*a*) and 19(*b*). FIG. 19(*a*) is an enlarged sectional view showing the tip of a fuel injection valve according to the present embodiment and FIG. 19(*b*) is a further enlarged view showing the vicinity of the nozzle hole. The components represented by the same reference numerals as FIG. 18 have the functions identical or equal to the seventh embodiment and thus the explanations are omitted.

The point different from the seventh embodiment is that the tip of a valve element 82 is nearly flat.

In the present embodiment, a valve element 82 (corresponding to the valve element 3 of the previous embodiments) is structured so that the shape of the tip may be flat and formed by machining or the like.

Figure 19B:
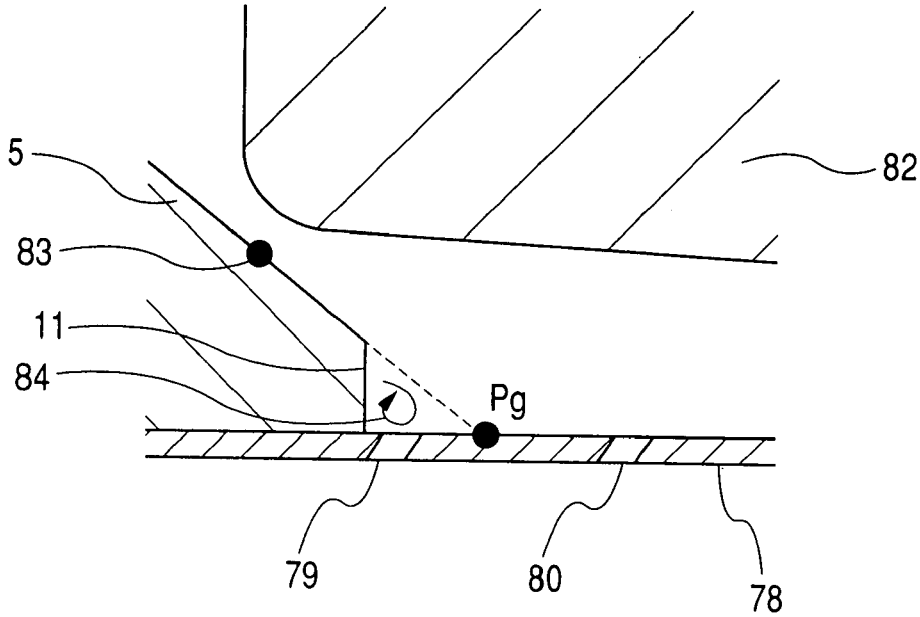

By employing such a configuration too, like the first embodiment, a nozzle hole 79 (corresponding to the nozzle holes 7*c* and 79 of the previous embodiments) is placed outside the intersection line (virtual circular line including intersection Pg of the extension of the tangential line at the seat position 83 (corresponding to the seat positions 30, 67, 71, and 75 of the previous embodiments) for the valve element 82 and a nozzle plate 78 (corresponding to the nozzle plate 6 of the previous embodiment) as shown in FIG. 19B.

By so doing, exfoliation occurs in the fuel flowing along the inclined surface including the seat position 83 at the wall surface 11 forming the fuel cavity on the downstream side of the seat and the local turbulence (local tumble flow) 84 is formed on the upstream side of the nozzle hole of the nozzle hole 79. Consequently, the local turbulence enters into each spray and thereby atomization is accelerated. Here, in the present embodiment too, the same functions and effects as the first embodiment can be obtained.

Embodiment 9

Figure 20A:
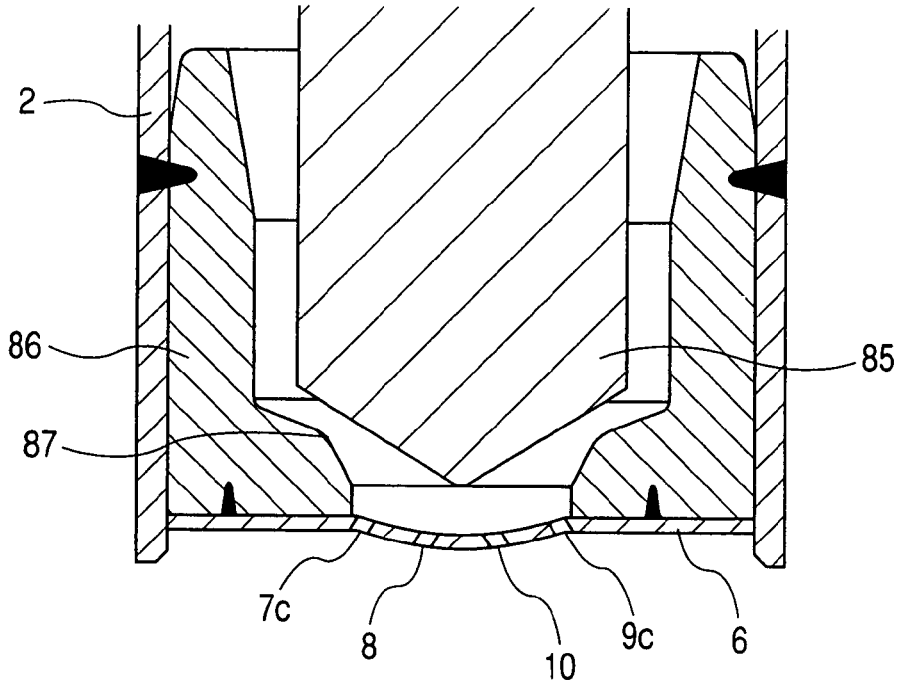
FIGS. 20 (*a*) and (*b*) comprise enlarged sectional views showing the nozzle portion of a fuel injection valve according to a ninth embodiment of the present invention.

The ninth embodiment of a fuel injection valve to which the present invention is applied is explained in reference to FIGS. 20(*a*) and 20(*b*). FIG. 20(*a*) is an enlarged sectional view showing the tip of a fuel injection valve according to the present embodiment and FIG. 20(*b*) is a further enlarged view showing the vicinity of the nozzle hole. The components represented by the same reference numerals as FIGS. 2 and 5 have the functions identical or equal to the first embodiment and thus the explanations are omitted. In the first to eighth embodiments, a valve element has a curved surface and a nozzle body has a slope and thereby they tightly touch each other and are used as a seat for fuel.

The different point of the present embodiment is that a valve element 85 (corresponding to the valve elements 5 and 82 of the previous embodiment) has an inclined surface like a needle valve and a nozzle body 86 has a curved surface including the valve seats.

Figure 20B:
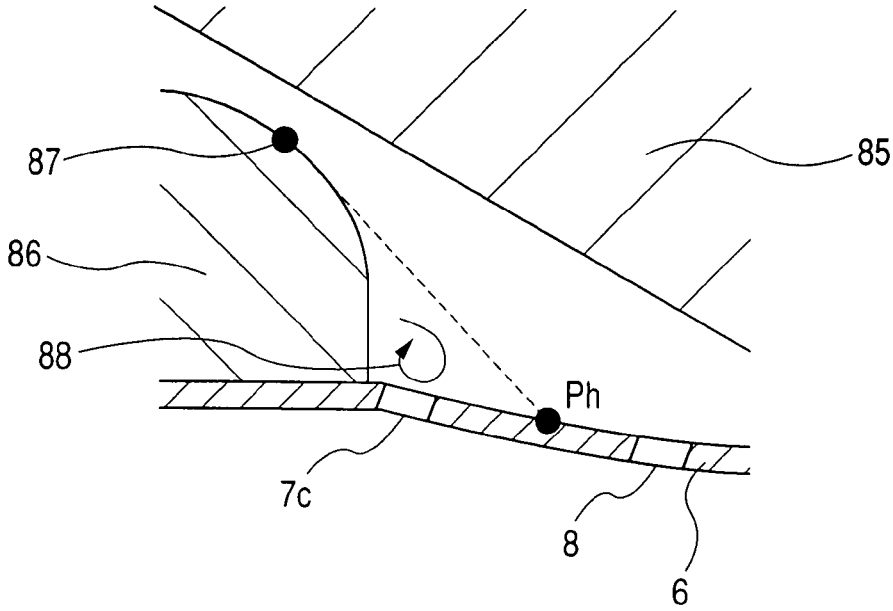

By employing such a configuration too, as shown in FIG. 20B, like the first embodiment, a nozzle hole 7*c* (and 7*a*-7*b*, 7*d*-74, and 9*a*-9*e*) is placed outside the intersection line (virtual circular line including intersection point Ph of the extension of the tangential line at the seat position 87 for a valve element 85 and a nozzle plate 6. Hence the local turbulence (local tumble flow) 88 is formed in fuel on the upstream side of the nozzle hole 7*c*. Consequently, the local turbulence enters into each splay, thereby atomization is accelerated. Here, in the present embodiment too, the same functions and effects as the first embodiment can be obtained.

Example 10

Figure 21:
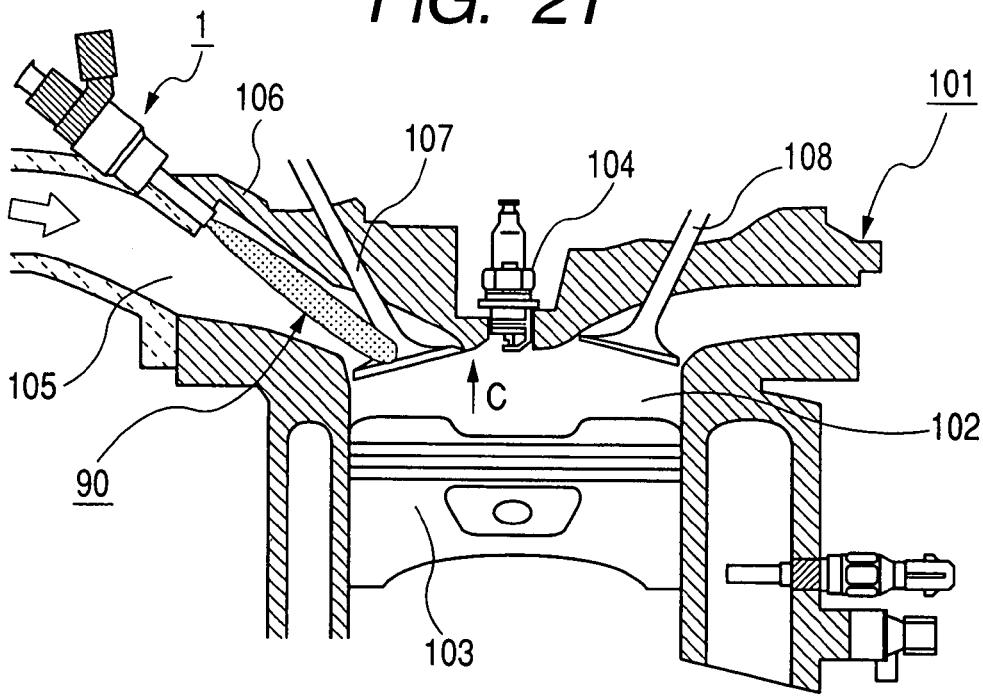
FIG. 21 is a sectional view showing spray of a fuel injection valve and an internal combustion engine according to a tenth embodiment of the present invention.
Figure 22:
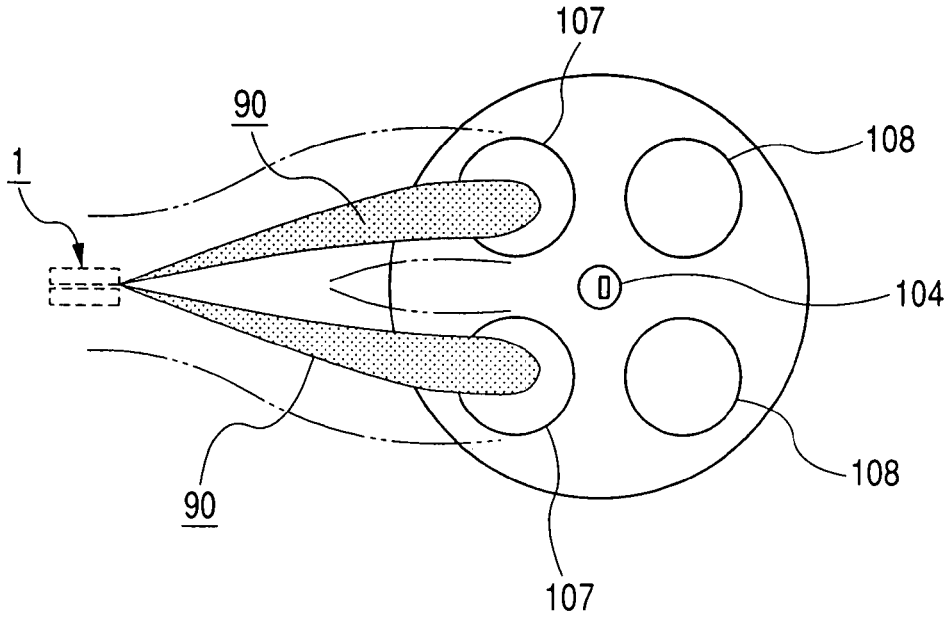
FIG. 22 is a view viewed from the C direction in FIG. 21 according to the tenth embodiment of the present invention.

An example wherein a fuel injection valve according to the present embodiment is mounted on an internal combustion engine is explained in reference to FIGS. 21 to 23.

FIG. 21 is a sectional view in the case where a fuel injection valve according to an embodiment of the present invention is mounted on an internal combustion engine. An internal combustion engine 101 comprises: an intake port 106 to which a fuel injection valve 1 is installed; an intake pipe 105 acting as a path to take in air from exterior; intake valves 107 to which the fuel injection valve 1 injects fuel spray 90; a combustion chamber 102 in which fuel is combusted; a cylinder 103 to compress a mixture in the combustion chamber; an ignition plug 104 to ignite the compressed mixture gas; and exhaust valves 108 acting as on-off valves to discharge a combusted exhaust gas to a catalyst not shown in the figure.

FIG. 22 is a view viewed from the C direction in FIG. 21. As shown in FIG. 22, spray 90 of the fuel injection valve 1 is injected to the intake valves 107 of the internal combustion engine 101. The spray 90 is directed to the dual intake valves 107 and adheres on the outer surface of the intake valves 107 in the vertically long-elliptic thin fluid film state.

When a thin film is formed on the intake valve 107 by well-atomized highly-dispersive spray, a good combustion result is obtained. It is more desirable to apply vertically-long elliptic spray on the intake valve 107. The reason is that, when an intake valve 107 opens, the injected fuel travels toward an ignition plug 104 surely because the fuel is prone to be attracted by a relatively-rapid intake valve-inside air flow, at the same time, it is possible to prevent the fuel from adhesion to an intake port wall surface and forming a rich mixture at combustion. By so doing, it is possible to reduce noxious exhaust gas HS from the internal combustion engine and simultaneously obtain the stable drive of the internal combustion engine.

FIG. 23 shows the results of measuring the emissions of HC in engine bench tests and in-car tests. Both the angles θ2 and θ3 are small in the case of the conventional fuel injection valve. In contrast however, it has been clarified that, in the case where both the angles θ2 and θ3 are large that is an embodiment according to the present invention, namely in the case of highly-dispersive spray, the effect in reducing HC is obtained. Further, in the case where both the angles θ2 and θ3 are large and the angle θ3 is larger than the angle θ2 that is another embodiment according to the present invention, namely in the case of vertically-long ellipse spray, HC reduces further. The reason why vertically-long ellipse spray is good is that, as stated above, when an intake valve 107 opens, fuel is attracted by a relatively-rapid air flow on the inner side and directed to an ignition plug 104 surely and, at the same time, it is possible to prevent the fuel from adhesion to the intake port wall surface and forming the rich mixture at combustion.

As stated above, it is possible to reduce emissions such as HC, etc. from an internal combustion engine by forming dual-direction spray that is vertically-long and highly dispersive.

According to the above-mentioned embodiments, the following advantages are obtained.

Split of a fluid film of the injected fuel sprays is accelerated to change into fine fluid drops, thereby it is possible to accelerate the split of a fluid film and realize splay having small particle diameters. Further, since adjacent sprays do not interfere with each other at least within the distance of an area where split of the fuel spray-fluid film occurs, it is possible to realize spray of a high dispersion. As a result, it is possible to realize well-atomized dual-direction spray of a high dispersion.

Such well-atomized spray of a high dispersion accelerates thin fluid film of the fuel on the intake valve and forms a highly-combustible mixture of air/fuel in a combustion chamber. In particular, when ellipse shaped (namely vertically-long spray) is formed, fuel spray is drawn toward the center of a combustion chamber (around an ignition plug) by intake gas flow of a high air flow rate closer to the inside of the intake valve and fuel adhesion against the wall in the combustion chamber is suppressed. As a result, it is possible to obtain an effective fuel and reduce noxious exhaust gas from an internal combustion engine.

What is claimed is:

1. A fuel injection valve comprising a valve seat, a movable valve element which is seated on or separated from said valve seat, and a nozzle member having a plurality of nozzle holes, at least one of said valve element and valve seat having a curved surface at a contact position where they contact with each other when said valve element is seated on said valve seat, wherein two or more of said nozzle holes are provided outside an intersection line of a virtual extension surface along a tangential line to said curved surface at said contact position and a surface of said nozzle member, and a ratio L/D of the shortest interval (L) between said nozzle holes to a diameter (D) of each nozzle hole is four or more.

2. A fuel injection valve comprising a valve seat, a movable valve element which is seated on or separated from said valve seat, and a nozzle member having a plurality of nozzle holes, at least one of said valve element and valve seat having a curved surface at a contact position where they contact with each other when said valve element is seated on said valve seat, wherein fuel sprays injected from said nozzle holes are integrated into two fuel sprays directed toward two directions, and the sum of a spray spread angle (θ2) of each spray viewed from a direction perpendicular to a plane including said two directions and a spray spread angle (θ3) thereof viewed from a direction parallel with a plane including the two directions is 30 degrees or more.

3. A fuel injection system for an internal combustion engine comprising dual intake valves for opening and closing two intake ports respectively, and a fuel injection valve according to claim 2 which is driven on the basis of a control signal from an internal combustion engine controller and placed on an upstream side of said intake valves, wherein two fuel sprays injected in two directions from said injection valve are directed toward centers of said intake ports respectively, and cross-sectional areas of said two fuel sprays on outer surfaces of valve heads of said intake valves are formed into elliptical shape capable of being within areas of said outer surfaces of said valve heads respectively.

4. A fuel injection valve comprising a valve seat, a movable valve element which is seated on or separated from said valve seat, and a nozzle member having a plurality of nozzle holes, at least one of said valve element and valve seat having a curved surface at a contact position where they contact with each other when said valve element is seated on said valve seat, wherein fuel sprays injected from said nozzle holes are integrated into two fuel sprays directed toward two directions, and a relationship between a spray spread angle (θ2) of each spray viewed from a direction perpendicular to a plane including said two directions and a spray spread angle (θ3) thereof viewed from a direction parallel with a plane including the two directions is $\theta 2 < \theta 3$.

5. A fuel injection valve comprising a valve seat, a movable valve element which is seated on or separated from said valve seat, and a nozzle member having a plurality of nozzle holes, at least one of said valve element and valve seat having a curved surface at a contact position where they contact with each other when said valve element is seated on said valve seat, wherein fuel sprays injected from said nozzle holes are integrated into two fuel sprays directed in two directions, and a ratio H/ha between an average peak height (ha) obtained by dividing an integral of a flow rate of each of said two fuel sprays passing through a cross section at a specific position by a maximum spray spread width thereof at the same specific position and a peak height (H) in a flow rate distribution is two or less.

6. A fuel injection valve comprising a valve seat, a movable valve element which is seated on or separated from said valve seat, and a nozzle member having a plurality of nozzle holes, at least one of said valve element and valve seat having a curved surface at a contact position where they contact with each other when said valve element is seated on said valve seat, wherein two or more of said nozzle holes are provided outside an intersection line of a virtual extension surface along a flow direction of fuel flowing on said seat when said valve element is separated from said seat and a surface of said nozzle member, and a ratio L/D of the shortest interval (L) between said nozzle holes to a diameter (D) of each nozzle hole is four or more.

7. A fuel injection valve comprising a valve seat with a conical surface whose diameter is reduced toward the downstream side, a movable valve element which is seated on or separated from said valve seat, and a nozzle member having a plurality of nozzle holes, wherein two or more of said nozzle holes are provided outside an intersection line of a virtual extension surface along said seat and said nozzle member, and a ratio L/D of the shortest interval (L) between said nozzle holes to a diameter (D) of each nozzle hole is four or more.

* * * * *